US007333929B1

(12) United States Patent
Chmounk et al.

(10) Patent No.: US 7,333,929 B1
(45) Date of Patent: Feb. 19, 2008

(54) MODULAR SCALABLE COMPRESSED AUDIO DATA STREAM

(76) Inventors: Dmitri V. Chmounk, #17-11/1 Russkaya St., Novosibirsk, 630058 (RU); Richard J. Beaton, 4250 Watling Street, Burnaby, B.C. V5J 1V2 (CA); Darrell P. Klotzbach, 3561 Sandpebble Dr., San Jose, CA (US) 95136; Paul R. Goldberg, 744 La Para Ave., Palo Alto, CA (US) 94306

( * ) Notice: Subject to any disclaimer, the term of this patent is extended or adjusted under 35 U.S.C. 154(b) by 0 days.

(21) Appl. No.: 11/296,072

(22) Filed: Dec. 6, 2005

Related U.S. Application Data

(63) Continuation of application No. 09/952,627, filed on Sep. 13, 2001, now abandoned.

(51) Int. Cl.
*G10L 11/00* (2006.01)

(52) U.S. Cl. ..... 704/200; 704/200.1

(58) Field of Classification Search ..... 704/200, 704/200.1
See application file for complete search history.

(56) References Cited

U.S. PATENT DOCUMENTS 4,074,069 A * 2/1978 Tokura et al. ..... 704/208
5,222,189 A 6/1993 Fielder
5,347,611 A * 9/1994 Chang ..... 704/206
5,388,209 A 2/1995 Akagiri
5,451,954 A 9/1995 Davis
5,623,577 A 4/1997 Fielder
5,632,003 A 5/1997 Davidson
5,845,243 A 12/1998 Smart et al.
5,890,106 A 3/1999 Bosi-Goldberg
5,890,125 A 3/1999 Davis
5,956,674 A 9/1999 Smyth
5,974,380 A 10/1999 Smyth
5,983,191 A 11/1999 Ha et al.
5,987,181 A * 11/1999 Makiyama et al. ..... 382/239
5,987,407 A 11/1999 Wu
6,006,179 A 12/1999 Wu
6,029,126 A 2/2000 Malvar
6,091,773 A 7/2000 Sydorenko
6,092,041 A 7/2000 Pan et al.
6,098,039 A 8/2000 Nishida
6,108,625 A 8/2000 Kim (Continued)

OTHER PUBLICATIONS

U.S. Appl. No. 09/95627, filed Sep. 13, 2001, Beaton et al., Parent application of present.

(Continued)

*Primary Examiner*—David Hudspeth
*Assistant Examiner*—Jakieda Jackson
(74) *Attorney, Agent, or Firm*—William Johnson; Blake Welcher

(57) ABSTRACT

Methods and apparatus are provided for the creation and utilization of unique compressed data stream compositions, structures and formats which allow for the alteration of the data stream's data rate without first decoding the data stream back to its uncompressed form and then re-encoding the resulting uncompressed data at a different data rate. Such methods and apparatus perform this data rate alteration, known as scaling, such that optimal quality is maintained at each scaled data rate, while performing said scaling with low computational complexity. In addition, the present invention provides for data rate alteration in small increments. A unique application for the disclosed bit rate scaling method and apparatus is also described.

33 Claims, 11 Drawing Sheets

U.S. PATENT DOCUMENTS

| | | | | |
|---|---|---|---|---|
| 6,115,689 | A | 9/2000 | Malvar | |
| 6,122,618 | A | 9/2000 | Park | |
| 6,216,107 | B1 | 4/2001 | Rydbeck | |
| 6,289,306 | B1 * | 9/2001 | Van Der Vleuten et al. | 704/219 |
| 6,356,870 | B1 * | 3/2002 | Hui et al. | 704/500 |
| 6,434,519 | B1 | 8/2002 | Manjunath et al. | |
| 6,446,037 | B1 | 9/2002 | Fielder | |
| 6,664,913 | B1 | 12/2003 | Craven | |
| 2002/0004718 | A1 | 1/2002 | Hasegawa | |
| 2002/0176353 | A1 * | 11/2002 | Atlas et al. | 370/203 |
| 2004/0122662 | A1 | 6/2004 | Crockett | |
| 2007/0063877 | A1 | 3/2007 | Shmunk | |

OTHER PUBLICATIONS

Ken C. Pohlman, "Perceptual Coding," in Principles of Digital Audio, Ch. 10, pp. 303-362 and 430-436.

Int. Org. for Standardization, ISO/IEC JTCI/SC29/WG11, Coding of moving Pictures and audio, N3156, 1999/ Maui version.

"AES Standart for Digital Audio" Audio Eng. Society, vol. 48, No. 6, Jun. 2000, pp. 565-583.

* cited by examiner

Table 1. G1 Mapping Table

| High Resolution Grid Sub-band | Grid 1 Sub-Band Number | | | | | | | | | | |
|---|---|---|---|---|---|---|---|---|---|---|---|
| | 0 | 1 | 2 | 3 | 4 | 5 | 6 | 7 | 8 | 9 | 10 |
| 0 | 1 | 0 | 0 | 0 | 0 | 0 | 0 | 0 | 0 | 0 | 0 |
| 1 | 0 | 1 | 0 | 0 | 0 | 0 | 0 | 0 | 0 | 0 | 0 |
| 2 | 0 | 0 | 1 | 0 | 0 | 0 | 0 | 0 | 0 | 0 | 0 |
| 3 | 0 | 0 | 0 | 1 | 0 | 0 | 0 | 0 | 0 | 0 | 0 |
| 4 | 0 | 0 | 0 | 0 | 0.5 | 0 | 0 | 0 | 0 | 0 | 0 |
| 5 | 0 | 0 | 0 | 0 | 0.5 | 0 | 0 | 0 | 0 | 0 | 0 |
| 6 | 0 | 0 | 0 | 0 | 0 | 0.5 | 0 | 0 | 0 | 0 | 0 |
| 7 | 0 | 0 | 0 | 0 | 0 | 0.33333 | 0.09524 | 0 | 0 | 0 | 0 |
| 8 | 0 | 0 | 0 | 0 | 0 | 0.16667 | 0.19048 | 0 | 0 | 0 | 0 |
| 9 | 0 | 0 | 0 | 0 | 0 | 0 | 0.28571 | 0 | 0 | 0 | 0 |
| 10 | 0 | 0 | 0 | 0 | 0 | 0 | 0.21429 | 0.05556 | 0 | 0 | 0 |
| 11 | 0 | 0 | 0 | 0 | 0 | 0 | 0.14286 | 0.11111 | 0 | 0 | 0 |
| 12 | 0 | 0 | 0 | 0 | 0 | 0 | 0.07143 | 0.16667 | 0 | 0 | 0 |
| 13 | 0 | 0 | 0 | 0 | 0 | 0 | 0 | 0.22222 | 0 | 0 | 0 |
| 14 | 0 | 0 | 0 | 0 | 0 | 0 | 0 | 0.17778 | 0.03636 | 0 | 0 |
| 15 | 0 | 0 | 0 | 0 | 0 | 0 | 0 | 0.13333 | 0.07273 | 0 | 0 |
| 16 | 0 | 0 | 0 | 0 | 0 | 0 | 0 | 0.08889 | 0.10909 | 0 | 0 |
| 17 | 0 | 0 | 0 | 0 | 0 | 0 | 0 | 0.04444 | 0.14545 | 0 | 0 |
| 18 | 0 | 0 | 0 | 0 | 0 | 0 | 0 | 0 | 0.18182 | 0 | 0 |
| 19 | 0 | 0 | 0 | 0 | 0 | 0 | 0 | 0 | 0.15152 | 0.02778 | 0 |
| 20 | 0 | 0 | 0 | 0 | 0 | 0 | 0 | 0 | 0.12121 | 0.05556 | 0 |
| 21 | 0 | 0 | 0 | 0 | 0 | 0 | 0 | 0 | 0.09091 | 0.08333 | 0 |
| 22 | 0 | 0 | 0 | 0 | 0 | 0 | 0 | 0 | 0.06061 | 0.11111 | 0 |
| 23 | 0 | 0 | 0 | 0 | 0 | 0 | 0 | 0 | 0.03030 | 0.13889 | 0 |
| 24 | 0 | 0 | 0 | 0 | 0 | 0 | 0 | 0 | 0 | 0.16667 | 0 |
| 25 | 0 | 0 | 0 | 0 | 0 | 0 | 0 | 0 | 0 | 0.13889 | 0 |
| 26 | 0 | 0 | 0 | 0 | 0 | 0 | 0 | 0 | 0 | 0.11111 | 0.05 |
| 27 | 0 | 0 | 0 | 0 | 0 | 0 | 0 | 0 | 0 | 0.08333 | 0.1 |
| 28 | 0 | 0 | 0 | 0 | 0 | 0 | 0 | 0 | 0 | 0.05556 | 0.15 |
| 29 | 0 | 0 | 0 | 0 | 0 | 0 | 0 | 0 | 0 | 0.02778 | 0.2 |
| 30 | 0 | 0 | 0 | 0 | 0 | 0 | 0 | 0 | 0 | 0 | 0.25 |
| 31 | 0 | 0 | 0 | 0 | 0 | 0 | 0 | 0 | 0 | 0 | 0.25 |

*FIG._24*

Table 2. Base Function Synthesis Correction Coefficients

For Group 5:

| F_dlt | 0 | 1 | 2 | 3 | 4 |
|---|---|---|---|---|---|
| 0 | 0.01 | -0.0037 | -0.002 | -0.00694 | -0.00184 |
| 1 | 0.04167 | 0 | 0 | -0.02083 | -0.01235 |
| 2 | 0.125 | 0.0558 | 0.03307 | -0.01645 | -0.00975 |
| 3 | 0.15625 | 0.0625 | 0.03704 | -0.00625 | -0.0037 |
| 4 | 0.1996 | 0.07813 | 0.0463 | 0.00227 | 0.00135 |
| 5 | 0.2 | 0.0625 | 0.03704 | 0.02083 | 0.00741 |
| 6 | 0.21277 | 0.05556 | 0.03292 | 0.02083 | 0.01235 |
| 7 | 0.21739 | 0.04735 | 0.02806 | 0.03472 | 0.02058 |
| 8 | 0.21739 | 0.03472 | 0.02058 | 0.04735 | 0.02806 |
| 9 | 0.21277 | 0.02083 | 0.01235 | 0.05556 | 0.03292 |
| 10 | 0.2 | 0.02083 | 0.00741 | 0.0625 | 0.03704 |
| 11 | 0.1996 | 0.00227 | 0.00135 | 0.07813 | 0.0463 |
| 12 | 0.15625 | -0.00625 | -0.0037 | 0.0625 | 0.03704 |
| 13 | 0.125 | -0.01645 | -0.00975 | 0.0558 | 0.03307 |
| 14 | 0.04167 | -0.02083 | -0.01235 | 0 | 0 |
| 15 | 0.01 | -0.00694 | -0.00184 | -0.0037 | -0.002 |

For Group 4:

| F_dlt | 0 | 1 | 2 | 3 | 4 |
|---|---|---|---|---|---|
| 0 | 0.005 | -0.02 | 0.0125 | -0.30303 | 0.002 |
| 1 | 0.10417 | 0.04 | -0.025 | 0.03333 | -0.02 |
| 2 | 0.125 | 0.01 | 0.01429 | -0.05 | -0.02 |
| 3 | 0.15625 | -0.00062 | -0.00049 | -0.00062 | -0.00049 |
| 4 | 0.15625 | -0.00062 | -0.00049 | -0.00062 | -0.00049 |
| 5 | 0.125 | -0.05 | -0.02 | 0.01 | 0.01429 |
| 6 | 0.10417 | 0.03333 | -0.02 | 0.04 | -0.025 |
| 7 | 0.005 | -0.30303 | 0.002 | -0.02 | 0.0125 |

For Group 3:

| F_dlt | 0 | 1 | 2 | 3 | 4 |
|---|---|---|---|---|---|
| 0 | 0.14286 | 0.125 | -0.02857 | -0.03571 | 0.02083 |
| 1 | 0.18182 | 0.05882 | 0.03333 | 0.02128 | 0.01 |
| 2 | 0.18182 | 0.02128 | 0.01 | 0.05882 | 0.03333 |
| 3 | 0.14286 | -0.03571 | 0.02083 | 0.125 | -0.02857 |

FIG._25

MODULAR SCALABLE COMPRESSED AUDIO DATA STREAM

This application is a continuation of application Ser. No. 09/952,627 filed on 13 Sep. 2001 now abandoned, and claims priority of that application.

BACKGROUND OF THE INVENTION

This invention is relates to the encoding of an audio signal, such as music, into a compressed data stream, the distribution of this compressed data stream on physical or electronic media, and the decoding of this compressed data stream into a psychoacoustically acceptable representation of the originally encoded audio signal. More specifically, it relates to unique data stream compositions, structures and formats which allow for the alteration of the data rate associated with an encoded compressed data stream without first decoding the data stream back to its uncompressed form and then recoding the resulting uncompressed data at a different data rate. It also relates to the methods and apparatus used to perform this data rate alteration.

The entertainment industry has spent many millions of dollars to capitalize on the opportunities created by the availability of digitally compressed music and video programs. Using high quality compression technology, audio and video content can now be distributed over widely deployed networks, such as the Internet, directly to consumers. This gives artists, record labels, movie studios, and the owners of the content, the ability to initiate and maintain direct contact with their customers and thus be in the position to gather market information of unprecedented accuracy while very effectively promoting their entertainment products. In addition, with the audio and video program material being provided to consumers in the form of compressed digital bit streams over the Internet, the cost of CD and DVD replication, as well as the cost of delivering physical media through retail outlets, are no longer in the equation. Thus, it can be readily seen that the entertainment industry has a strong interest in making the profitable electronic delivery of compressed music and video content an everyday reality.

The main objective of an audio compression algorithm is to create a sonically acceptable representation of an input audio signal using as few digital bits as possible. This permits a low data rate version of the input audio signal to be delivered over limited bandwidth transmission channels, such as the Internet, and reduces the amount of storage necessary to store the input audio signal for future playback. The level of artifacts introduced by a particular audio compression/decompression process into the recovered decompressed signal, and thus the quality of the decompressed audio signal, is, for the most part, inversely proportional to the number of bits used to encode the audio signal. The lower the number of bits used the more noticeable the difference between the recovered decompressed audio and the original audio signal. For those applications in which the data capacity of the transmission channel is fixed, and non-varying over time, or the amount, in terms of minutes, of audio that needs to be stored is known in advance and does not increase, traditional audio compression methods, such as those described in the following book can be effectively used: Pohlmann, Ken C., "Principles of Digital Audio" Fourth Edition, McGraw-Hill (2000), particularly chapters 10 and 12 (primarily pp. 430-436). These chapters are incorporated herein in their entirety by this reference.

In these forms of prior art, the data rate at which an audio signal is compressed, and thus its level of audio quality, is determined at the time of compression encoding. No further reduction in data rate can be effected without either recoding the original signal at a lower data rate or decompressing the compressed audio signal and then recompressing this decompressed signal at a lower data rate. If this fixed rated compressed audio signal is delivered over a reliable transport channel, that does not vary in its data carrying capacity over time, the needs of the consumer, to which this audio data is delivered, will be satisfied. However, if the carrying capacity of the transport channel diminishes, as would be the case during the occurrence of an Internet net blockage, or if more subscribers connect to the channel, utilizing more capacity than the channel has to offer, there is nothing that can be done to maintain the quality of service to any particular consumer. Under these circumstances, the consumer will be subjected to varying length periods of service interruption. This is a fundamental limitation of audio compression schemes in common use today.

Another situation in which the compression processes described in the Pohlmann book can cause consumer dissatisfaction occurs in the case in which a consumer has a fixed amount of memory available to store musical content which is desired to be reproduced by a portable music player. Many of the handheld portable audio appliances available today are based on storage mechanisms such as Flash ROM, with storage capacities as low as 32 megabytes. If the consumer has available to him or her audio compressed at a fixed rate of 128 kilobits per second, the maximum length of the combined musical selections that will be able to be stored on this 32 megabyte storage module will be about 33 minutes. If the consumer wishes to store more music on this storage module the only choice that would be available to the consumer would be to tediously re-encode the desired musical selections at a lower data rate.

Yet another limitation of this prior art is its inability to easily "scale" a single audio bit stream when used in different applications, each of which require audio compressed at a different data rate. Currently, a high quality, high data rate, compressed audio stream is converted into one of a lower data rate representation, of lower quality, by first decoding the data stream back to its uncompressed form and then recoding the resulting uncompressed data at a different data rate. This compression/decompression process is not only tedious it also causes additional losses in audio quality, whether or not the subsequent encoding process is at a different data rate as compared to the previous encoding process. The loss in quality associated with recoding once compressed audio is well known. The AES41-2000 Audio Engineering Society Standard, which defines a process that can be followed to reduce this loss in quality, entitled "AES Standard For Digital Audio—Recoding Data Set For Audio Bit Rate Reduction," appears in the *Journal of the Audio Engineering Society*, Volume 48, Number 6, June 2000, pages 565 through 583.

One general prior art technique used to create a bit stream with scalable characteristics, and circumvent the limitations previously described, employs an encoder/decoder or codec which encodes the input audio signal as a high bit rate data stream composed of subsets of low bit rate data streams. In this approach, low bit rate streams are used to construct the higher bit rate streams. These encoded low bit rate data streams can be extracted from the coded signal and combined to provide an output data stream whose bit rate is adjustable over a wide range of bit rates. One approach to implement this concept is to first encode data at a lowest supported bit rate, then encode an error between the original signal and a decoded version of this lowest bit rate bit stream. This encoded error is stored and also combined with the lowest supported bit rate bit stream to create a second to lowest bit rate bit stream. Error between the original signal and a decoded version of this second to lowest bit rate signal is encoded, stored and added to the second to lowest bit rate bit stream to form a third to lowest bit rate bit stream an so on. This process is repeated until the sum of the bit rates associated with bit streams of each of the error signals so derived and the bit rate of the lowest supported bit rate bit stream is equal to the highest bit rate bit stream to be supported. The final scalable high bit rate bit stream is composed of the lowest bit rate bit stream and each of the encoded error bit streams. Note that for this scheme, called difference coding, to be viable, the error signal must be compressed to a substantially lower bit rate than the original. Also note that the increment of audio improvement associated with each of the encoded error "helper signals" included in the bit stream will be directly proportional to the compressed data rate of each helper signal (the higher the data rate of the helper signal the larger the increment of audio improvement) and the scaling resolution will be inversely proportional to the compressed data rate of each helper signal (the higher the data rate of the helper signal the courser the scaling resolution).

A second general technique, usually used to support a small number of different bit rates between widely spaced lowest and highest bit rates, employs the use of more than one compression algorithm to create a "layered" scalable bit stream. In this approach, a hybrid of compression algorithms is used to cover the desired range of scalable bit rates. The apparatus that performs the scaling operation on a bit stream coded in this manner chooses, depending on output data rate requirements, which one of the multiple bit streams carried in the hybrid bit stream to use as the coded audio output. To improve coding efficiency and provide for a wider range of scaled data rates, data carried in the lower bit rate bit streams can be used by higher bit rate bit streams to form additional higher quality, higher bit rate bit streams.

The first scalable bit stream approach described above is computationally intensive. Since extensive analysis of the bit stream being scaled is required, significant processing power is needed to attain real time performance. This is especially true if this approach is configured to permit fine grained scaling of the bit stream's data rate. With real time operation being a necessity for many applications which benefit from the use of bit stream scaling, a more computationally efficient method is clearly needed.

Note that the second scalable bit stream approach outlined above is far less computationally intensive as compared to the first, when the bit rate streams used in this technique serve as independent data elements and are not employed to augment the quality of higher bit rate bit streams. Simplified versions of the first scalable bit stream method can approach this lower complexity, however in this case only a limited number of bit stream bit rates can be supported. Although lower complexity has the benefit of real time operation, limited scalability range and resolution makes the simplified versions of these two approaches unsuitable for many applications. Clearly a new approach which provides for real time operation over a wide range of closely spaced scalable data rates is of great benefit.

SUMMARY OF THE INVENTION

It is an object of the present invention to provide a means for compressing audio signal information such that the resulting compressed bit stream can be modified in bit stream rate, also known as bit rate scaling.

Another object of this invention is to provide for the creation of a compressed bit stream that can be bit rate scaled by simple means.

It is a further object of this invention to provide a method and apparatus for the creation of a compressed bit stream that can be bit rate scaled in real time with the use of low digital signal processing power.

Yet another object of this invention is to provide a compressed bit stream that can be bit rate scaled over a wide range of bit rates.

Yet a further object of this invention is to provide a compressed bit stream that can be scaled in fine increments An additional object of this invention is to provide a compressed bit stream that can be smoothly scaled from it highest bit rate to its lowest bit rate.

A still further object of this invention is to provide a method and apparatus for bit scaling a compressed bit stream in fine increments over a wide range of bit rates Another object of this invention is to provide a means for automatically decoding a scaled compressed audio bit stream input, which varies over a range of bit rates, into a time domain audio signal having a fixed data rate.

Briefly and generally, a unique method and apparatus to encode, scale and decode a bit rate scalable, compressed audio bit stream are described. A general aspect of the invention is to decompose an input audio, video, multimedia or other signal into its fundamental quality elements and place these elements into an encoded frame of data, such that these elements appear in each of these encoded frames of data in order of their contribution to decoded signal quality. Specifically with regard to an audio signal, the basic concept employed by the invention is to decompose an input audio signal into its fundamental psychoacoustic elements and place these elements into an encoded frame of data, such that these elements are identified in each of these encoded frames of data with their respective orders of psychoacoustic importance. It is preferred that these elements be placed in an order of their psychoacoustic importance. A continuing sequence of these psychoacoustically ordered frames make up the encoded scalable bit stream.

One arrangement to achieve this objective is to place the least psychoacoustically important audio elements, that is those elements that have the least impact on perceived audio quality when the encoded bit stream is decoded, in the frame such that they arrive at a bit scaling apparatus first in time. A simple scaling apparatus is then employed to reduce the bit rate by discarding less important psychoacoustic elements, while passing the remaining more important psychoacoustic elements. This scaling apparatus additionally alters the ancillary data in each frame that defines which audio elements are carried in the frame, thus permitting a subsequent decoding operation to ignore missing audio elements and correctly decode only those audio elements present. This approach provides for the smooth, fine resolution reduction of bit stream bit rate, while reducing the quality of the decoded audio signal as slowly as possible as the bit stream bit rate is reduced.

Additional objects, features and advantages of the present invention are included in the following discussion of exemplary embodiments, which discussion should be read with the accompanying drawings. Although these exemplary embodiments pertain to audio data, it will be understood that video, multimedia and other types of data may also be processed in similar manners.

BRIEF DESCRIPTION OF THE DRAWINGS

FIG. 24 is Table 1 of G1 mapping sub-band numbers; and

FIG. 25 is Table 2 of base function synthesis correction coefficients.

DESCRIPTION OF EXEMPLARY EMBODIMENTS

General Illustration of the Invention

Figure 1:
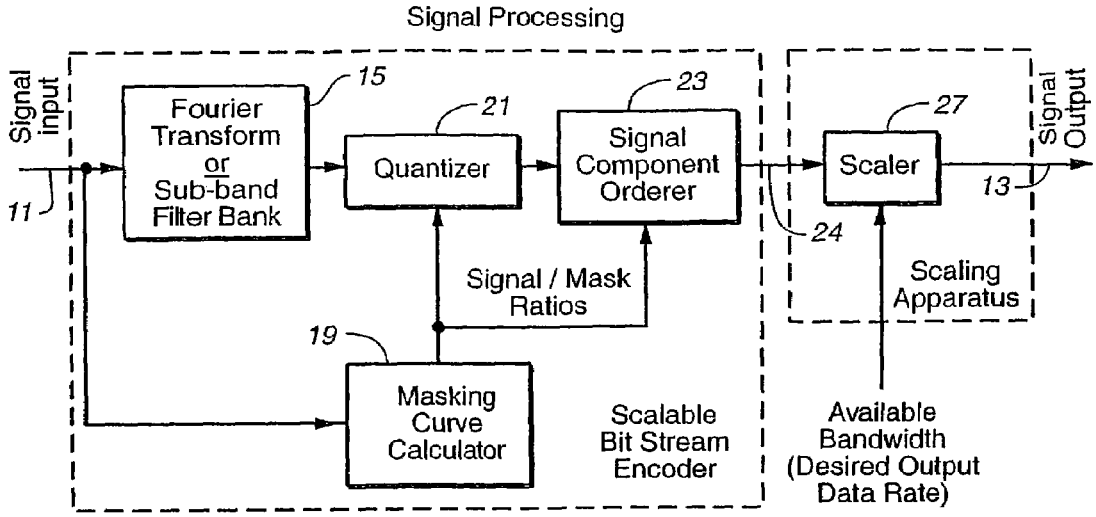
FIG. 1 is a block diagram illustration of a general embodiment of a scalable bit stream encoder according to an audio signal embodiment of the present invention.

With reference initially to FIG. 1, the processing of an input signal at 11 is illustrated. A signal at an output 13 is generated as a scaled down version of the input signal, in order to fit within a limited bandwidth of a data transmission system, storage system, further processing system or the like. The blocks included in FIG. 1 show the various processing steps of this generalized example. The illustrated processing can be applied to an input signal with various content, forms and types. The input signal may be in an analog, digital or other form. Its type may be a signal that occurs in repetitive discrete amounts, in a continuous stream or some other type. The content of the input signal may be virtually anything, including audio and/or video data that are the focus of the examples described hereinafter.

A primary application of the signal processing illustrated in FIG. 1 is to those signals having components that are not equally important to the ultimate receiver of the signal. The ultimate receiver may be a human, through hearing or sight, for example, or an electronic device that has limited capability to use the entire signal. The input signal 11 is first broken down into such components and those components are then ranked by their relative importance to the ultimate receiver. As many of the components as possible are included in the output signal 13 for transmission or storage within the available bandwidth, beginning with the most important and including as many of the remaining components in order of their importance to the ultimate receiver as the available bandwidth allows.

The example application of this signal processing chosen for emphasis herein is with an input audio signal 11, and the ultimate receiver is the human ear which masks out certain sound frequencies in a known manner. The frequency components that contribute the least to the audio signal perceived by the human ear are eliminated from the signal when necessary to reduce its bandwidth.

Figure 2:
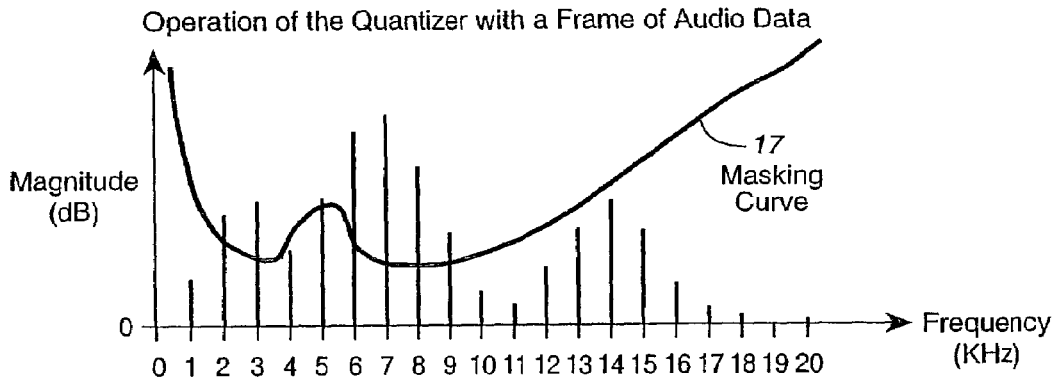
FIG. 2 is a simplified example spectrum of a frame of the bit stream within the encoder of FIG. 1, with a psychoacoustic response masking curve superimposed.

As indicated by a block 15 of FIG. 1, the frequency spectra of a frame of the input signal 11 is generated by either taking a transform, such as a Fourier transform, of it or by passing it through a bank of filters to obtain the magnitudes of various frequency ranges (sub-bands). An example spectrum (greatly simplified for purposes of explanation from that experienced in practice) is illustrated in FIG. 2, wherein the magnitudes of an input signal in individual sub-bands including each of the 1, 2, 3 etc. kilohertz (kHz.) frequencies are shown. This processing proceeds on successive frames of data, one at a time, each frame usually representing a small fraction of one second of the sound signal.

Superimposed on the signal spectrum of FIG. 2 is a masking curve 17 that represents the magnitudes of the sound signal, as a function of frequency, that the human ear cannot likely hear. The shape of the curve 17 represents the relative insensitivity of the human ear to the very low and to the high frequency ranges. The curve 17 also shows an example of a strong signal in one frequency band masking out the signal in an adjacent band. A rise in the curve 17 in the 5 kHz. range is the result of the audio signal being very strong in the 6 and 7 kHz. ranges. The masking curve 19 is dynamically calculated for each data frame, as indicated by a block 19, from the known response characteristics of the human ear and the frequency distribution of sound signal during the frame. This process is explained in the aforementioned book of Pohlmann, chapter 10, which is entitled "Perceptual Coding," which chapter has been incorporated herein. The curve 17 is represented at an output of the block 19, in one implementation, as a series of ratios of the magnitudes of the signal in each of the frequency bands to the calculated masking level in those bands.

As is common in audio processing, particularly in compression algorithms, the individual frequency band magnitude values from the block 15 are quantized in a block 21 in accordance with the signal/mask ratios calculated by the block 19. These quantized values are the output of the block 21. Up until this point, the audio processing has generally followed known processing techniques. What is usually done is to transmit these quantized values.

Figure 3:
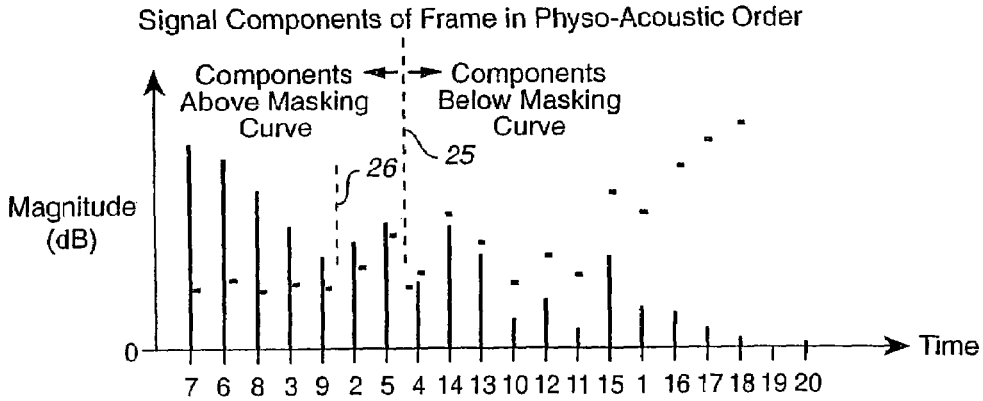
FIG. 3 shows frequency components of the example frame of FIG. 2 being placed in an order of importance to the psychoacoustic response.

But according to the present invention, as indicated by a block 23, the quantized frequency band magnitudes are placed in an order of their importance to the sound signal as perceivable by the human ear. As illustrated in FIG. 3, the component of the sound signal designated to contribute the most to the perceived signal is the magnitude of the 7 kHz. band of FIG. 2. The next is that of the 6 kHz. band, followed by that of the 8 kHz band, in turn followed by that of the 3 kHz. band, and so on. The output of the block 23 contains the full quantized magnitudes of these frequency bands but arranged in an order in time according to their importance to the signal as perceived by the human ear. The order of these components is that of their signal to mask level ratios, that with the highest ratio occurring first and that with the lowest ratio being last. A dashed line 25 of FIG. 3 indicates where the frequency band components that are higher than the masking curve end. Components occurring in time after the dashed line 25 have signal/mask ratios less than unity. A typical quantizer 21 may have already eliminated many or all of these components by allocating its limited total number of bits primarily to the other components having signal/mask ratios more than unity. Therefore, although the components below the masking curve are included in FIG. 3, they will most commonly have been eliminated by the quantizer 21.

The advantage of such ordering is that it is quite easy to limit the bandwidth of the signal, when necessary, by eliminating the frequency band components in order from the right side of FIG. 3. This is done by a scaler 27 (FIG. 1) that receives a signal indicating the available bandwidth of the system into which the output signal 13 is to be sent. The scaler 27 eliminates a number of the quantized frequency band magnitude values beginning with that having the lowest signal/mask ratio, then the component having the next lowest signal/mask ratio, and so on, until the data of the remaining components fits within the bandwidth constraint that is input to the scaler 27. In the example of FIG. 3, those components to the left of the dashed line 25, which are above the masking curve, but to the right of another dashed line 26 are eliminated by the scaler 27 in order to fit the remaining components to the left of the dashed line 26 within the available bandwidth. Of the components from the quantizer 21, after being placed in order by the block 23, those which are most important to the quality of the signal being transmitted are retained.

Figure 4:
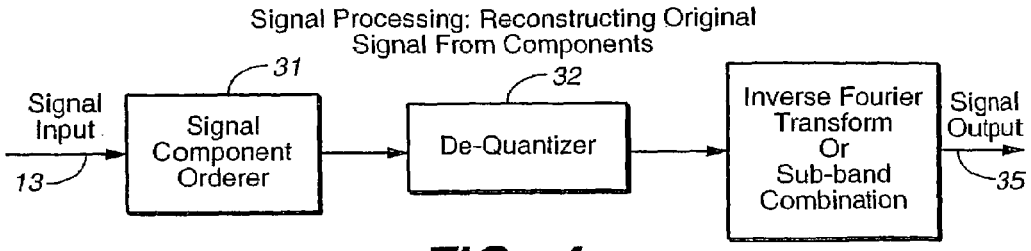
FIG. 4 is a block diagram illustration of a scalable bit stream decoder according to the present invention.
Figure 5:
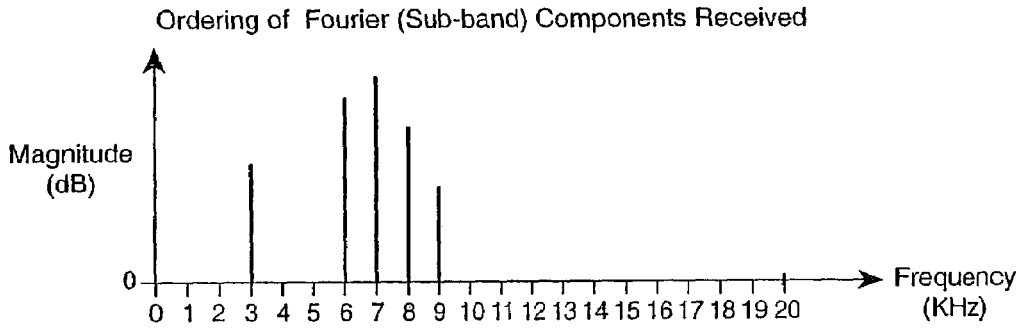
FIG. 5 shows frequency components reconstructed from a scaled signal generated according to the technique of FIGS. 1-3.

In addition to including the magnitudes of the remaining frequency band components in the data of the output signal 13, each component is identified by its frequency band or some other indication of its position within the spectrum of FIG. 2. This allows, as illustrated in FIG. 4, the reduced bandwidth version (shown in FIG. 5) of the original signal to be reconstructed from the output signal 13. A block 31 indicates that the individual pieces of component data of the signal 13 are arranged according to their relative order that is included as part of the data. FIG. 5 shows the result of this, assuming that the scaler 27 eliminated all of the frequency band components of FIG. 2 that have a signal/mask ratio of less than one. All of the components with a signal/mask ratio in excess of one (FIG. 3) are included in the reconstructed spectrum (FIG. 5) in their proper frequency band locations. Of course, fewer or more frequency band components can be included, depending upon the bandwidth constraint that has had to be met.

The ordered spectrum output of the block 31 is dequantized by reversing the effect of the quantizer 21 (FIG. 1), as indicated by a block 32, and then converted from the frequency domain back into the time domain by the processing indicated by a block 33. A resulting output signal 35 is a reconstructed version of the input signal 11 (FIG. 1). Depending upon the proportion of the frequency band components of the original signal that are eliminated, the human ear may not notice the limitation. By the process of the present invention, the least significant components are eliminated first, in order of their significance to the quality of the audio that will be recognized by the human ear.

Referring again to FIG. 1, in summary, the calculating functions identified by the blocks 15, 19, 21 and 23 form a scalable bit stream encoder. Its output 24 is a quantized stream of the components shown in FIG. 3, which has the relatively high data rate of the quantizer 21 but with its components re-ordered according to their relative importance to the quality of the signal. The scaler 27 controllably reduces that data rate to match the bandwidth of a transmission medium through which the signal is to be sent, or that of a recording medium on which the data is being stored, or the like, by eliminating the least significant components of the data stream. As an alternative to the encoder output 24 being applied directly to the scaler 27, as is shown in FIG. 1, the output 24 can be transmitted, stored or the like, and then separately reduced in bandwidth by passing the data through the scaler 27 at a different time and/or in a different place.

Although the identification of the relative importance of the frequency band components is most conveniently accomplished by transmitting or re-ordering them according to their importance, as described above, this relative importance may alternatively be identified by including a header field within each component record that specifies the rank of that component for the present frame. The orderer 23 is then omitted. The scaler 27 instead selects the most important components by reference to this field and assembles the output signal 13 to include as many of the components as the available bandwidth will allow, beginning with the most important and selecting others in order of their importance. The individual selected most important sub-band components are then transmitted in their order of occurrence, without the re-ordering described above.

Scalable Bit Stream Encoder

Figure 6:
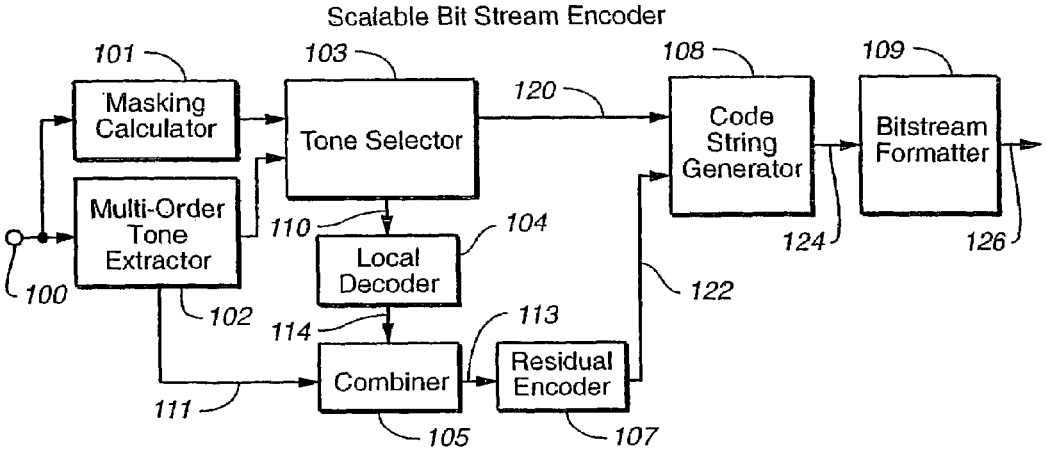
FIG. 6 illustrates one embodiment of a scalable bit stream encoder according to the present invention.

FIG. 6 shows a simplified block diagram of the scalable bit stream encoder of the present invention. The input signal 100 is applied to both Masking Calculator 101 and Multi-Order Tone Extractor 102. Masking Calculator 101 analyzes input signal 100 and identifies a masking level as a function of frequency below which frequencies present in input signal 101 are not audible to the human ear. Multi-Order Tone Extractor 102 identifies frequencies present in input signal 101 which meet psychoacoustic criteria that have been defined for tones, selects tones according to this criteria, quantizes the amplitude components of these selected tones, and places these tones into a tone list. All other frequencies that do not meet the criteria for tones are extracted from the input signal and output from Multi-Order Tone Extractor 102 in the time domain on line 111 as a residual signal. The masking level from Masking Calculator 101 and the tone list from Multi-Order Tone Extractor 102 are inputs to the Tone Selector 103. The Tone Selector 103 first sorts the tone list provided to it from Multi-Order Tone Extractor 102 by relative power over the masking level provided by Masking Calculator 101. It then uses an iterative process to determine which tonal components will fit into a frame of encoded data. The amount of space available in a frame for tonal components depends on the predetermined, before scaling, bit rate of the encoded bit stream. This predetermined bit rate sets the maximum bit stream rate as well as the highest audio quality that can be delivered to the end user of the bit stream. A wide range of predetermined bit stream rates can be chosen depending upon the application supported by the bit stream. When the scalable bit stream is delivered to consumers on high data rate, large capacity media, such as Digital Video Disc, Compact Disc or DataPlay cartridges, data rates equal to or higher than 192 kilobits/sec can be chosen. An initial guess of 12 bits per tonal component is used to predict how many tonal components will fit into a frame of encoded output. During this iterative process, tonal components determined not to fit in a frame, represented by signal 110 in FIG. 6, are locally decoded via Local Decoder 104 to convert them back into the time domain. The time domain representation of the tonal components that do not fit into a frame of encoded output appear on line 114 and are combined with Residual Signal 111 from Multi-Order Tone Extractor 102 in Combiner 105. The complete Residual signal 113 is thus formed. Note that the signals appearing on 114 and 111 are both time domain signals so that this combining process can be easily effected. The combined Residual signal 113 is further processed by the Residual Encoder 107. The first action performed by Residual Encoder 107 is to process the output signal 113 through a filter bank which subdivides the signal into critically sampled time domain frequency sub-bands. Further decomposition, quantization and arrangement of these sub-bands into psychoacoustically relevant order is then performed. The Code String Generator 108 takes input from the Tone Selector 103, on line 120, and Residual Encoder 107 on line 122, and encodes values from these two inputs using entropy coding well known in the art. The Bit Stream Formatter 109 assures that psychoacoustic elements from the Tone Selector 103 and Residual Encoder 107, after being coded through the Code String Generator 108, appear in the proper position in the bit stream.

Scalable Bit Stream and Scaling Mechanism

Figure 7:
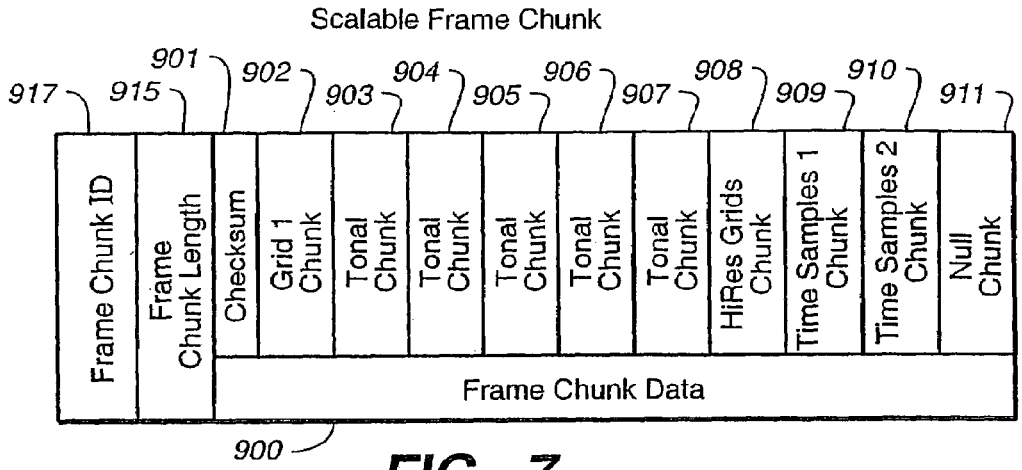
FIG. 7 schematically represents a scalable frame of data produced by the scalable bit stream encoder of the present invention.

The structure and order of elements placed in the bit stream, as defined by the present invention, provides for wide bit range, fined grained, bit stream scalability. It is this structure and order that allows the bit stream to be smoothly scaled by external mechanisms. FIG. 7 depicts the structure and order of elements in one embodiment of a scalable bit stream which follows the teachings of the present invention. It should be understood that this bit stream example is based on the audio compression codec of FIG. 6 that decomposes the original bit stream into a particular set of psychoacoustically relevant elements. Other audio compression codecs, based on other decomposition rules, can be used in the practice of the present invention and will provide a different set of psychoacoustically relevant elements.

The Scalable bit stream used in this example is made up of a number of Resource Interchange File Format, or RIFF, data structures called "chunks", although other data structures can be used. This file format which is well known by those skilled in the art, allows for identification of the type of data carried by a chunk as well as the amount of data carried by a chunk. Note that any bit stream format that carries information regarding the amount and type of data carried in its defined bit stream data structures can be used to practice the present invention. FIG. 7 shows the layout of a scalable bit rate frame chunk 900, along with sub-chunks 902, 903, 904, 906, 906, 907, 908, 909, and 910 which comprise the psychoacoustic data being carried within frame chunk 900. Although FIG. 7 only depicts chunk ID and chunk length for the frame chunk, sub-chunk ID and sub-chunk length data is included within each sub-chunk. FIG. 7 shows the order of chunks in a frame of the scalable bit stream. These chunks contain the psychoacoustic audio elements produced by the scalable bit stream encoder shown in FIG. 6. In addition to the chunks being arranged in psychoacoustic importance, the audio elements within the chunks are also arranged in psychoacoustic importance. Null Chunk 911 of FIG. 7, which is the last chunk in the frame, is used to pad chunks in the case where the frame is required to be a constant or specific size. Therefore Chunk 911 has no psychoacoustic relevance and, as depicted in FIG. 7, the least important psychoacoustic chunk, Time Samples 2 Chunk 910, appears on the right hand side of the figure and the most important psychoacoustic chunk, Grid 1 Chunk 902, appears on the left hand side of the figure. By operating to first remove data from the least psychoacoustically relevant chunk at the end of the bit stream, Chunk 910 and working towards removing greater and greater psychoacoustically relevant elements toward the beginning of the bit stream, Chunk 902, the highest quality possible is maintained for each successive reduction in bit rate. It should be noted that the highest bit rate, along with the highest audio quality, able to be supported by the bit stream, is defined at encode time. However, the lowest bit rate after scaling is defined by the level of audio quality that is acceptable for use by an application. Each psychoacoustic element removed does not utilize the same number of bits. The scaling resolution for the current implementation of the present invention ranges from 1 bit for elements of lowest psychoacoustic importance to 32 bits for those elements of highest psychoacoustic importance. The mechanism for scaling the bit stream does not need to remove entire chunks at a time. As previously mentioned, audio elements within each chunk are arranged so that the most psychoacoustically important data is placed at the beginning of the chunk. For this reason, audio elements can be removed from the end of the chunk, one element at a time, by a scaling mechanism while maintaining the best audio quality possible with each removed element. The scaling mechanism removes audio elements within the a chunk as required, updating the Chunk Length field of the particular chunk from which the audio elements were removed, the Frame Chunk Length 915 and the Frame Checksum 901. As will be seen from the detailed discussion of the exemplary embodiments of the present invention, with updated Chunk Length for each chuck scaled, as well as updated Frame Chunk Length and Frame Checksum information available to the decoder, the decoder can properly process the scaled bit stream, and automatically produce a fixed data rate audio output signal, even though there are chunks within the bit stream that are missing audio elements, as well as chunks that are completely missing from the bit stream.

Scalable Decoder

Figure 8:
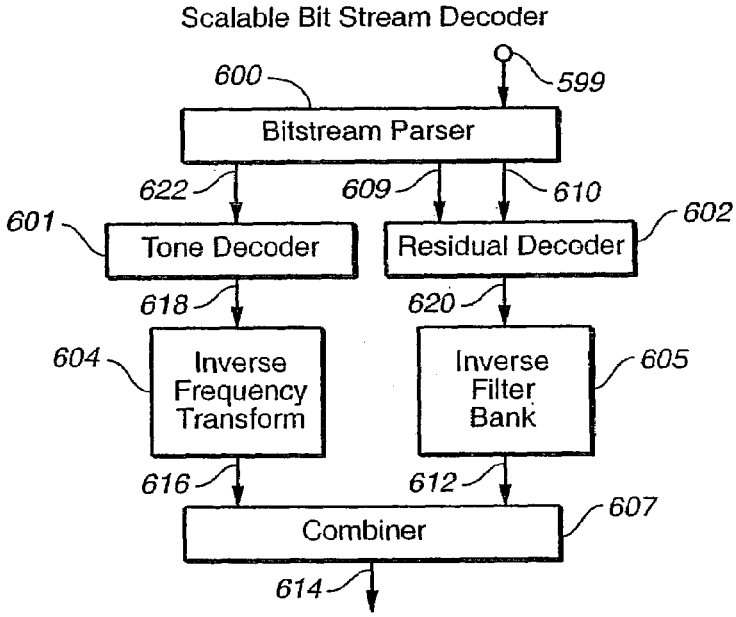
FIG. 8 illustrates an embodiment of the scalable bit stream decoder of the present invention.

A simplified version of the Scalable Decoder of the present invention is shown in FIG. 8. The Bitstream Parser 600 reads RIFF chunk information from scaled input bit stream 599 and passes the elements of that information to the appropriate decoder. For the purposes of this simplified summary, this information is passed to Tone Decoder 601 or Residual Decoder 602. Elements decoded via the Tone Decoder 601 are processed through the Inverse Frequency Transform 604 which converts the signal back into the time domain. Elements which the Bitstream Parser 600 determines to be part of the residual decoding process are processed though the Residual Decoder 602. The output of the Residual Decoder 602, containing 32 frequency sub-bands represented in the time domain, is processed through the Inverse Filter Bank 605. Inverse Filter Bank 605 recombines the frequency sub-bands into one signal. The time domain output 612 of Filter Bank 605 and the time domain output 616 of Inverse Frequency Transform 604 are passed to Combiner 607. Combiner 607 combines these two signals to form decoded time domain audio signal 614. Note that although input audio data stream 599 can display a wide range of scaled bit stream rates, output audio signal 614 displays a fixed audio output rate, even though there are missing psychoacoustic elements in input audio data stream 599.

Scaled Bit Stream Application

The present invention's unique capability to adjust the data rate of audio bit streams serves as a means of allowing fixed bandwidth transmission channels, carrying multiple bit streams, to seamlessly accommodate additional subscribers. This permits a service provider to handle subscriber peak overload by sharing the additional load across the whole system. Prior art required the service provider to either deny service to additional subscribers or remove already supported subscribers from the system. In a typical wireless audio distribution application, the limited radio spectrum channel capacity is apportioned between subscribers such that the maximum number of subscribers that can be accommodated is defined. Without the use of the present invention, when this subscriber limit is reached, no more subscribers can be accommodated until additional transmitters or repeaters are installed. By applying the technology of the present invention in such an audio delivery service, the bit rate to all users is incrementally adjusted to accommodate new users so that new customers are not refused service. The slight reduction in audio bit rate experienced by all subscribers is difficult to notice because of the smooth, fine grain scaling provided by the invention, which reduces quality as a function of the psychoacoustic relevance of the audio elements removed.

For the purposes of the following discussion a "Program Stream" is defined as an individual data stream containing a single audio program. This audio program can be a mono, stereo or multichannel audio signal. In addition "Transport Stream" is defined as a multiplexed set of one or more Program Streams, formatted for transmission over a data network. To service a request for a new Program Stream, the unique application which employs the current invention performs the following steps:

Determine the bit rate in the Transport Stream to be employed by the requested Program Stream, B(p).

For each of N Program Streams already in the Transport Stream, scale each Program Stream, i, from it's current bit rate B(i) to the new bit rate B(j):

$$B(j)=B(i)*(1-[B(p)/(N*B(i))]) \quad (1)$$

Add the new Program Stream to the Transport Stream

To release a Program Stream, the following inverse operation is performed to restore all other streams to their previous bit rates:

Remove the released Program Stream from the Transport Stream, N=N−1.

Determine the bit rate in the Transport Stream of the Program Stream to be released, B(p).

For each of N remaining Program Streams, scale each remaining Program Stream, i, from it's current bit rate B(i) to the new bit rate:

$$B(j)=B(i)*(1+[B(p)/(N*B(i))]) \quad (2)$$

Figure 9:
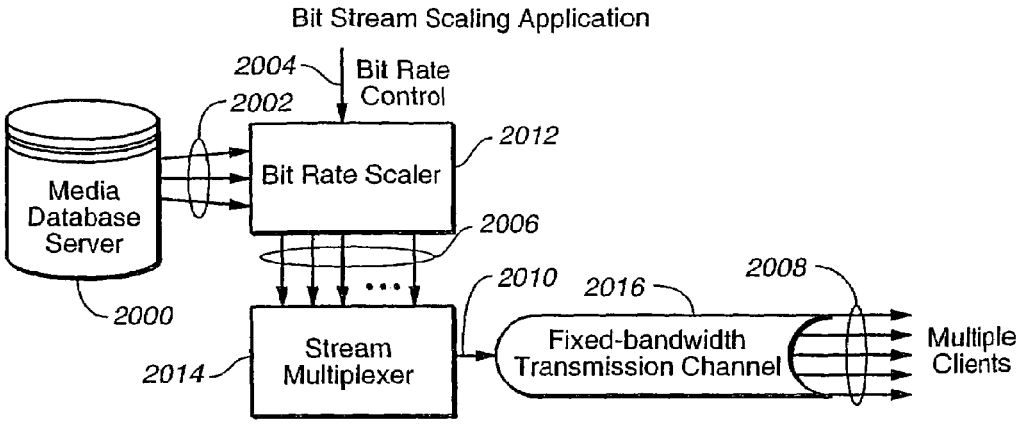
FIG. 9 illustrates a bit stream scaling application employing the scalable bit stream of the present invention.

One embodiment of the above application of the present invention is depicted in FIG. 9. Program streams numbers 2002 from Media Database Server 2000 are provided in the scalable format of the invention. Any one stream of 2002 may be an additional Program Stream that is to be added to Transport Stream 2016, which is already at capacity. When a Program Stream is added, the application scales, in Bit Rate Scaler 2019, the new Program Stream, plus all previous Program Streams already carried in the Transport Stream, to a data rate set by Bit Rate Control line 2004, in Bit Rate Scaler 2012. Bit Rate Scaler 2012 employs Equation (1) above, which defines how to scale each bit stream for Program Stream addition according to the present unique application. When a Program Stream is removed from Transport Stream 2016, the application scales, in Bit Rate Scaler 2012, all Program Streams remaining in the Transport Stream, to a data rate set by Bit Rate Control line 2004, in Bit Rate Scaler 2012. Bit Rate Scaler 2012 employs Equation (2) above, which defines how to scale each bit stream after Program Stream removal according to the present unique application.

A More Specific Embodiment

The description of a specific embodiment will now be given. The description will start by detailing one method of encoding, followed by the layout of the bit stream, the process of decoding the bit stream which may have shortened elements, and an apparatus for scaling the bit stream.

Encoder

FIG. 6 is a block diagram of the encoder according to one embodiment of the invention. Following is a detailed description of each element from FIG. 6.

Input Signal 100

Input Signal 100 is a full-band, dual-channel digital audio signal such as might be found on a conventional audio Compact Disc. The sampling rate is normally 44100 Hz and samples are represented as 16-bit values with the left and the right channels interleaved. The present encoder expects such a signal in RIFF WAVE or AIFF format, although the encoder could easily be adapted to deal with different formats. The present encoder can code audio signals with sampling rates other than 44100 Hz as well as single channel audio. Parts of the encoder makes decisions as to a primary channel and secondary channel. The secondary channel information is generally stored as differences from the primary. Throughout this document the subscripts 'p' and 's' shall refer to primary and secondary channels respectively. Like many audio encoders in the prior art, the encoder breaks Input Signal 100 into frames. In the present embodiment of this invention, a frame is 4096 samples, representing 93 milliseconds in time.

Masking Calculator 101

Figure 10:
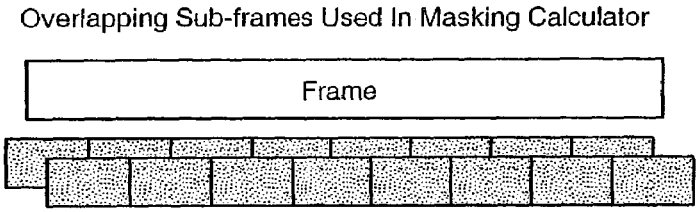
FIG. 10 depicts the overlapping sub-frames used in the masking calculator of one version of the encoder of the present invention.

Masking Calculator 101 is one of the two blocks that takes Input Signal 100 as its input. Masking Calculator 101 provides masking level calculations to Tone Selector 103. For each frame's worth of time samples, Masking Calculator 101 divides Input Signal 100 into 16 half overlapping sub-frames using a Hanning window, though other window types such as Blackmann or Hamming windows can be chosen. FIG. 10 shows a graphic representation of these over-lapping sub-frames. Masking calculator 101 performs a Fast Fourier Transform, hereafter referred to as a FFT, to transform the data into spectral components, and a spectral power calculation is performed on the resulting spectral data. The spectral power calculation is then further divided into a number of blocks, block boundaries being equally spaced on an auditory scale. The standard Bark scale is currently used. Each spectral component within a block is replaced with the average value for the block.

Multi-Order Tone Extractor 102

Figure 11:
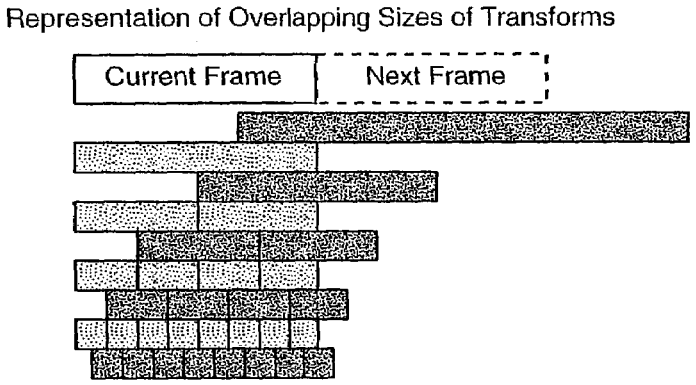
FIG. 11 is a representation of the overlapping sizes of transforms as used in one version of the encoder of the present invention.

Multi-Order Tone Extractor 102 is the second block that takes Input Signal 100 as its input. Multi-Order Tone Extractor 102 uses five orders of overlapping FFTs, starting from the largest and working down to the smallest, to detect tones through the use of a base function. FFTs of size: 8192, 4096, 2048, 1024, and 512 are used respectively, for an audio signal whose sampling rate is 44100 Hz. Other transform sizes could be chosen. FIG. 11 graphically shows how the FFTs overlap each other. The base function is defined by the equations:

$$F(t;A,l,f,\phi) = A_i \cdot \frac{1-\cos\left(\frac{2\pi}{l}\right)}{2} \cdot \sin\left(\frac{2\pi}{l} \cdot f \cdot t + \phi\right) \quad t \in [0, l]$$

$$F(t;A,l,f,\phi) = 0 \quad t \in [0, l]$$

where:

$A_i$=Amplitude=$(Re_i \cdot Re_i + Im_i \cdot Im_i) - (Re_{i+1} \cdot Re_{i+1} + Im_{i+1} \cdot Im_{i+1})$ t=time (t∈N being a positive integer value)

l=FFT size as a power of 2 l∈512, 1024, . . . , 8192)

Ø=phase f=frequency $$\left(f \in \left[1, \frac{1}{2}\right]\right)$$

Tones detected at each FFT size are locally decoded using the same decode process as used by the decoder of the present invention, to be described later. These locally decoded tones are phase inverted and combined with the original input signal through time domain summation.

Since tonal detection is done through detection of the base function given above, windowing of the input data before applying a FFT is not necessary. This is equivalent to using rectangular windowing. The following conditions approximate the defined base function given above and must be met for a component to be selected as a tonal component to be extracted:

1) The absolute amplitude, $A_i$, made by differencing the squares of neighboring spectral components ($A_i$=$(Re_i \cdot Re_i + Im_i \cdot Im_i) - (Re_{i+1} + IM_{i+1} \cdot Im_{i+1})$) should be greater than a predetermined minimum threshold. In the present embodiment, that minimum threshold is set at approximately −96 db.
2) The candidate base function should be separated from previously processed spectral lines of the same transform size and time position by at least two spectral lines.
3) The selected component should have even distribution within the frame interval.

The FFTs for this step are calculated at the same time as the FFTs used for Masking Calculator 101, the current embodiment employing FFTs half the size of the smallest FFT used to extract tones. If the amplitude of the spectral line of the base function being checked is 3 times lower than the amplitude of the base function in any of the FFTs from the Masking Calculation for the frame, then the base function is rejected.

4) The candidate component should be greater than a noise threshold determined by a psychoacoustic model based on concurrent masking theory well known to one skilled in the art.

The amplitude of components meeting the above criteria are quantized to a logarithmic scale using a fixed table. Some elements of the table are modified so as to improve audio quality as perceived by the ear. At each FFT stage the following psychoacoustically relevant information is stored: quantized amplitude of tonal components, phase of tonal components quantized to a linear 8 level scale, the spectral line number, the channel from which the component was obtained, the transform size at which the component was processed, and the component's position within a frame. The stored information is combined into a list and passed to Tone Selector 103.

Tone Selector 103

The Tone Selector 103 in FIG. 6 takes as input, data from the Mask Calculator 101 and the tone list from Multi-Order Tone Extractor 102. The Tone Selector 103 first sorts the tone list by relative power over the masking level from Mask Calculator 101, forming an ordering by psychoacoustic importance. The formula employed is given by:

$$P_k = A_k \cdot \frac{\sum_{i=0}^{l-1}\left(1-\cos\left(\frac{\pi(2i+1)}{l}\right)\right)}{\sqrt{M_{i,k}}}$$

where:

$A_k$=spectral line amplitude $M_{i,k}$=masking level for k's spectral line in i's mask sub-frame l=length of base function in terms of mask sub-frames The summation is performed over the sub-frames where the spectral component has non-zero value.

Tone Selector 103 then uses an iterative process to determine which tonal components from the sorted tone list for the frame will fit into the bit stream. In multi-channels sounds, where the amplitude of a tone is about the same in more than one channel, only the full amplitude and phase is stored in the primary channel; the primary channel being the channel with the highest amplitude for the tonal component. Other channels having similar tonal characteristics store the difference from the primary channel. Of the output bit rate of 256 kilobits per second, 36 kilobits per second are used for tonal component encoding. An initial guess of 12 bits per tonal component is used to predict how many tonal components will fit into the frame. During the iterative process, tonal components determined not to fit as tonal components (represented by signal 110 in FIG. 6) are locally decoded via Local Decoder 104, starting with those with least relative power (tail of the list). The time domain Residual Tonal Component signal 114 is combined in Combiner 105 with time domain Residual Signal 111 from Multi-Order Tone Extractor 102, forming the new time domain Residual plus Tonal Component signal 113. If there is enough room in the frame for the selected components, the iteration stops. Otherwise a new calculation to determine the number of tones that will fit is made, based on the new average of the number of bits actually used to encode tones, and the iterative loop is run again.

The data for each transform size encompasses a number of sub-frames, the smallest transform size covering 2 sub-frames; the second 4 sub-frames; the third 8 sub-frames; the fourth 16 sub-frames; and the fifth 32 sub-frames. There are 16 sub-frames to 1 frame. Tone data is grouped by size of the transform in which the tone information was found. For each transform size, the following psychoacoustic data is placed into the bit stream: Huffman coded sub-frame position, Huffman coded spectral position, Huffman coded quantized amplitude, and quantized phase. For multi-channel audio, Huffman coded differences between the amplitude from the primary channel and phase from the primary channel are placed in the bit stream immediately following the primary channel information.

Residual Encoder 107

Figure 12:
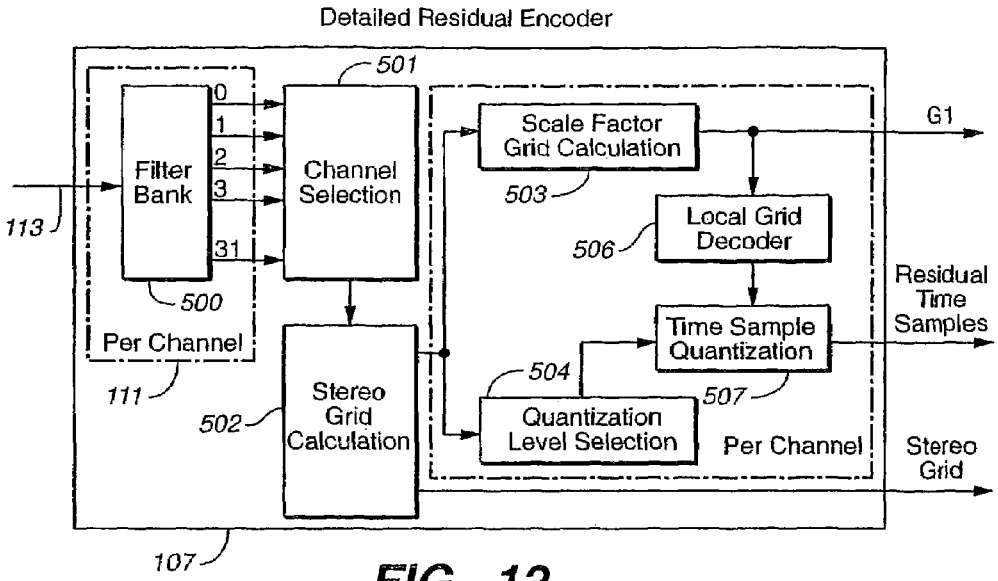
FIG. 12 depicts the detailed embodiment of the residual encoder used in an embodiment of the encoder of the present invention.

FIG. 12 shows the block diagram for the Residual Encoder 107 of FIG. 6. Output signal 113 of Combiner 105 is processed through Filter Bank 500 which subdivides the signal into 32 evenly spaced critically sampled frequency sub-bands in the time domain. The output of the filter bank for each frame, referred to in this discussion as grid G, is 32 sub-bands of 128 time samples each. The filter bank is applied to each channel of the audio signal. Scale Factor Grid Calculation 503 calculates grid G1, which is placed in the bit stream. The method for calculating G1 is now described. G0 is first derived from G. G0 contains all 32 sub-bands but only half the time resolution of G. The contents of the cells in G0 are quantized values of the maximum of two neighboring values of a given sub-band from G. Quantization (referred to in the following equations as Quantize) is performed using the same modified logarithmic quantization table as was used to encode the tonal components in the Multi-Order Tone Extractor 102. Each cell in G0 is thus determined by:

$$G0_{m,n}=\text{Quantize}(\text{Maximum}(G_{m,2n},G_{m,2n+1}))\ n\epsilon[0\ldots 63]$$

where:

m is the sub-band number n is the G0's column number

G1 is derived from G0. G1 has 11 overlapping sub-bands and ⅛ the time resolution of G0, forming a grid 11×8 in dimension. Each cell in G1 is quantized using the same table as used for tonal components and found using the following formula:

$$G1_{m,n} = \text{Quantize}\left(\sum_{l=0}^{31}\left(W_l\cdot\sqrt{\sum_{i=8n}^{8n+7} G_{l,i}^2}\right)\right)$$

where: $W_l$ is a weight value obtained from Table 1 (FIG. 24).

G0 is recalculated from G1 in Local Decoder 506. In Time Sample Quantization Block 507, output time samples from Filter Bank 500 (Grid G), which pass through Quantization Level Selection Block 504, are scaled by respective values in the recalculated G0 from Local Decoder 506, by division, and quantized to the number of quantization levels, as a function of sub-band, determined by quantization level selection block 504. These output time samples are then placed into the encoded bit stream. Time samples from sub-band 0 are quantized to 16 levels, sub-bands 1 and 2 to 8 levels, sub-bands 3 through 10 to 5 levels, sub-bands 11 through 25 to 3 levels, and sub-bands 26 through 31 to 2 levels. Time samples of sub-bands quantized to 16 levels (4 bits) and 2 levels (1 bit) are directly stored in the bit stream. Time samples of sub-bands quantized to 8 levels are Huffman coded and then stored in the bit stream. Time samples of sub-bands quantized to 3 and 5 levels are either Huffman coded, or packet coded, depending on which takes up the least amount of space in the bit stream, and then stored in the bit stream. In all cases, a model reflecting the psychoacoustic importance of the these audio elements is used for the bit stream storage operation.

Figure 22:
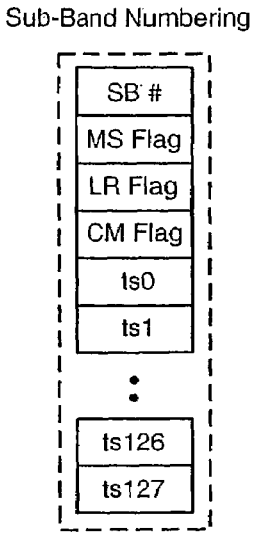
FIG. 22 depicts the sub-band numbering employed in an embodiment of the present invention.

In this embodiment of the present invention, the model of psychoacoustic importance employed is based on the number of quantization levels that have been used to quantize a particular time sample. Sub-bands using a higher number of quantization levels are more psychoacoustically important and are placed at the beginning of each frame of data comprising the bit stream. Audio elements of less psychoacoustic importance are placed at the end of each frame of data comprising the bit stream. With this arrangement psychoacoustic elements can be removed to scale the data rate of the bit stream, starting from the end of each frame of data, while maximum quality at any scaled data rate is maintained. Other models of psychoacoustic importance can be chosen. In another embodiment of the present invention, psychoacoustic models, which call for a dynamic reordering of sub-band psychoacoustic importance as a function of audio content, have bits reserved before each sub-band which detail the sub-band number, as shown in FIG. 22. This additional information is required by the decoder, to be later described, in order to properly decode sub-band data during the decoding process. When sub-bands are arranged in a fixed relationship, as defined by the first embodiment of the present invention, additional sub-band number information is not required.

Channel Selection 501 Used In Residual Encoder—For multi-channel audio, several calculations are made in Channel Selection block 501 to determine the primary and secondary channel for encoding as well as the method for encoding (Left-Right, or Middle-Side). The selection of primary channel is made based on the relative power of the channels over the frame. The following equations define the relative powers:

$$P_l = \sum_{i=0}^{15} L_i^2 \quad P_r = \sum_{i=0}^{15} R_i^2 \quad P_m = \sum_{i=0}^{15} (L_i + R_i)^2 \quad P_s = \sum_{i=0}^{15} (L_i - R_i)^2$$

The frequency sub-bands are encoded as Left-Right or Middle-Side representation. In Left-Right representation, the channel with the highest power for the sub-band is considered the primary and a single bit in the bit stream for the sub-band is set if the right channel is the channel of highest power. Middle-Side encoding is used for a sub-band if the following condition is met for the sub-band:

$$P_m > 2\cdot P_s$$

Stereo Grid Calculation 502 Used in Residual Encoder—Stereo Grid Calculation 502 provides a stereo panning grid in which stereo panning can roughly be reconstructed. The stereo grid is 4 sub-bands by 4 time intervals, each sub-band in the stereo grid covers 4 sub-bands and 32 samples from the output of Filter Bank 500, starting with frequency bands above 3 k Hz. Other grid sizes, frequency sub-bands covered, and time divisions could be chosen. Values in the cells of the stereo grid are the ratio of the power of the given channel to that of the primary channel, for the range of values covered by the cell. The ratio is then quantized to the same table as that used to encode tonal components.

Code String Generator 108

The Code String Generator 108 of FIG. 6 encodes input values using Huffman encoding; packet encoding of 3 values in 7 bits or 5 values in 8 bits; or direct encoding. For example, the equation y=x1+5*x2+25*x3 can be used to pack 3 values quantized to 5 levels in 7 bits. Sub-bands quantized to 3 or 5 levels may be coded using Huffman coding or packet coding; both methods being tried and the result requiring the least amount of space is placed into the bit stream. A flag before the sub-band samples is set if packet coding is used or un-set if Huffman coding is used. The output is passed to the Bitstream Formatter 108.

Bitstream Formatter 108

Bitstream Formatter 108 places the output values of Code String Generator into RIFF (Resource Interchange File Format) chunks, places chunks into their order of psychoacoustic importance, and writes out the file stream. Chunks are commonly defined in IFF (Interchange File Format) as blocks of data containing an identifier for the block, the size of the block, and some amount of data which is contained in the block. The order of elements in the bit stream will now be described.

Bit Stream Order

Figure 15:
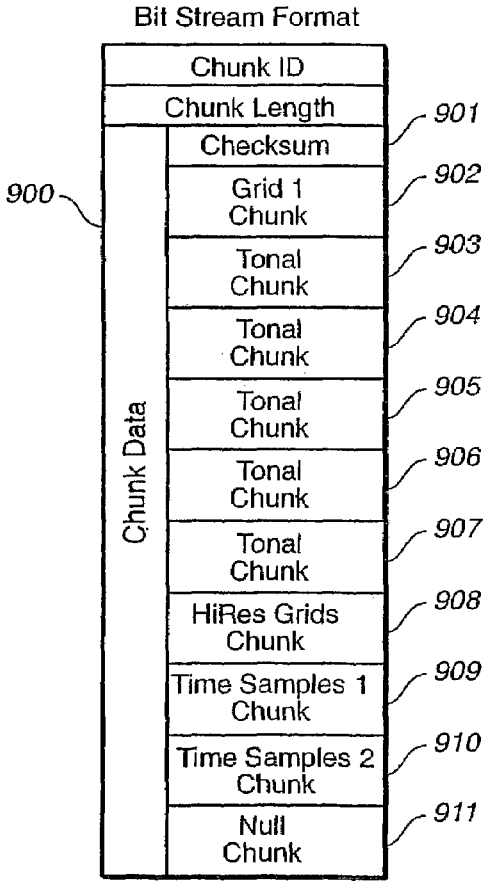
FIGS. 15, 16 and 17 illustrate a detailed schematic representation of the scalable bit stream chunk layout of one embodiment of the present invention.
Figure 16:
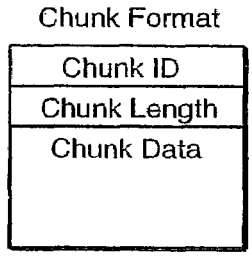
Figure 17:
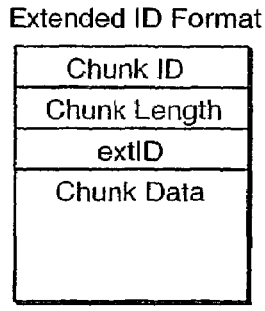

The bit stream is made up of a number of IFF (Interchange File Format) chunks. FIGS. 15 and 16 shows the layout of a chunk. A chunk is composed of three fields: chunk ID, chunk length, and chunk data. Those knowledgeable in the art are familiar with this chunk format. Chunk IDs in the bit stream are 8 bit values allowing for 256 unique ids with one ID reserved to allow for an additional 256 IDS after the initial 256 IDShave been used. The most significant bit of the chunk ID is used to indicate whether the given chunk is a short chunk or a standard chunk. If the most significant bit is set, the chunk is a standard chunk, chunk length is two bytes (16 bits) and the chunk data section can contain up to 65535 bytes of data. If the bit is not set, chunk length is one byte (8 bits) and the chunk data section can contain up to 255 bytes of data. Chunk data contains chunk length bytes of data, the format of which is specific to the type of chunk. For extended ID chunks, the extension mechanism is the insertion of another 8 bit extID field between the chunk length and chunk data elements. FIG. 17 shows the chunk layout for this extended chunk type. The data in each chunk is ordered so that the most psychoacoustically important data in the chunk is at the beginning and the least psychoacoustically important data is placed at the end of the chunk. This allows the bit stream to be scaled by external means, by removing data from the end of the chunk and updating chunk length, and if necessary, Checksum 901.

FIG. 15 shows the order of chunks in the present embodiment of the invention. The order of chunks within the bit stream is in the order of psychoacoustic importance, the most psychoacoustically important data being placed in the bit stream first. The bit stream may start with an optional two byte Checksum 901 that allows for some detection of transmission errors. The checksum is the 16 bit sum of all bytes in the frame except for the two checksum bytes. Two different chunk ID's for Frame Chunk 900 are used to specify the presence or non-presence of Checksum 901. The remaining data in Frame Chunk 900 are the chunks 902 through 911.

Figure 18:
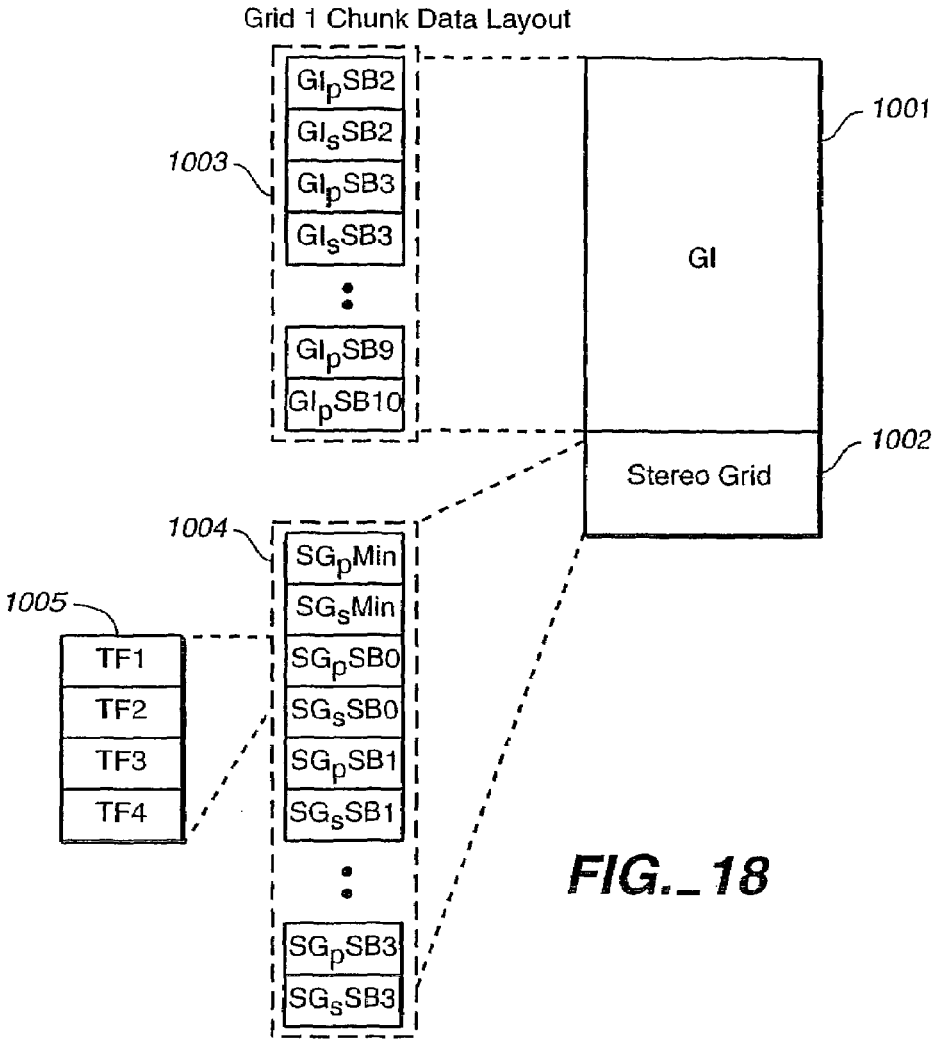
FIGS. 18 and 19 schematically depict detailed chunk layouts used in a version of the scalable bit stream of the present invention.

Due to the major psychoacoustic importance of Grid 1, Chunk 902, it must be present in the bit stream. Being required, it therefore either follows Checksum 901 or is the first data element in the data section of Frame Chunk 900. FIG. 18 further details the chunk data section of the Grid 1 Chunk. First in Grid 1 Chunk 902 is cell information G1 1001. For multi-channel audio, Stereo Grid 1002 follows G1 cell information 1001. Block 1003 provides more details regarding how G1 cell values are stored in the bit stream. G1 cell values are stored in sub-band order, starting with the third sub-band (SB2). The first two sub-bands of G1 (SB0 and SB1), representing lower frequencies, are stored in the HiRes Grids Chunk 908, to be subsequently described. Each sub-band box ($G1_p$ SB2, $G1_s$ SB2, etc.) in block 1003, starts with the first amplitude for the sub-band, followed by up to eight column and amplitude difference values from the previously stored value. Linear interpolation is used between values to provide 8 values for each G1 sub-band. For multi-channel audio, sub-bands of G1 representing frequencies less than 2 k Hz for other channels are interleaved with the sub-band information for the primary channel. Each value in the bit stream is Huffman coded. Block 1004 further details the bit stream contents of Stereo Grid 1002. The first two elements in Stereo Grid 1002 are the minimum values for the grid for each channel which are directly stored; the current embodiment using 4 bits for each value. Following the minimum values are the Huffman coded cell values for each sub-band; each sub-band containing four values as shown by block 1005. The sub-bands for each channel in the stereo grid are interleaved, as shown in block 1004 of FIG. 18.

As shown in FIG. 15, Five Tonal Chunks (903, 904, 905, 906, and 907) follow Grid 1 Chunk 902 in the bit stream, one chunk each for of the five transform sizes in which the tones were found, starting with the smallest transform size, working up to the largest. Optionally, one Tonal Chunk can be used in place of the five Tonal Chunks 903, 904, 905, 906, and 907. If one Tone Chunk is used, the data within the chunk is stored sequentially, for each transform size, as though they were separate chunks but saving space via the use of only one chunk ID and one chunk length instead of five. Each Tonal Chunk 903, 904, 905, 906, and 907 contains the sub-frame distance, the distance to the next spectral bin for the next tonal component, and the quantized tonal amplitude and quantized phase.

Figure 19:
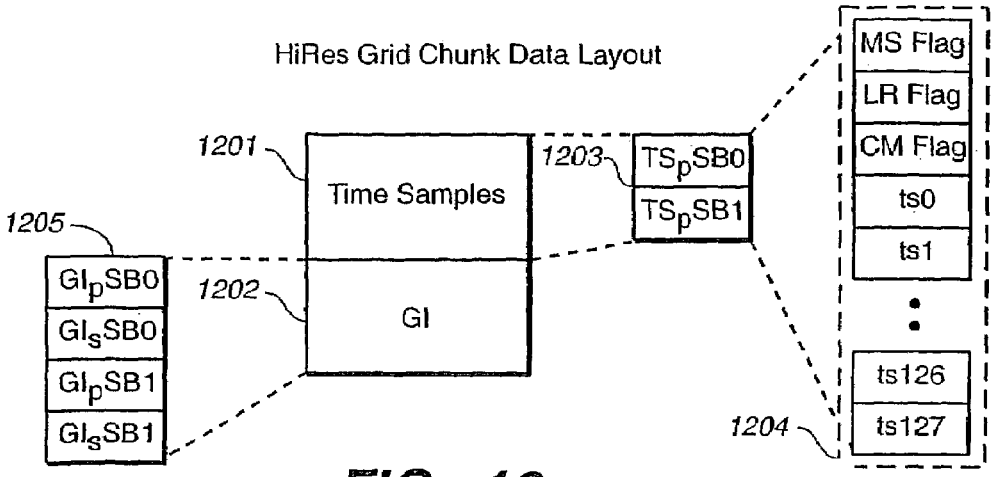

FIG. 19 further details the contents of the chunk data section of HiRes Grids Chunk 908. First in the HiRes Grids Chunk 908 are the Time Samples 1201 for the lowest two frequency sub-bands for the primary channel, followed by the lowest two G1 sub-bands for each channel. For multi-channel audio, the data for each channel's G1 sub-bands are interleaved. Blocks 1203 and 1204 further detail the placement of Time Samples in the bit stream. 128 samples are stored in order for each sub-band. For multi-channel audio, three flag bits precede the samples. Together, two of these flags indicate Middle-Side representation, Left-Right representation, and which channel is the primary channel. The third flag is used to indicate the coding method used for sub-bands quantized to either 3 or 5 levels. Further details on the order of the lowest two sub-bands of G1 are shown in block 1205 of FIG. 19. The values stored for each sub-band are stored via the same method used to store G1 values in Grid 1 Chunk 902.

Figure 20:
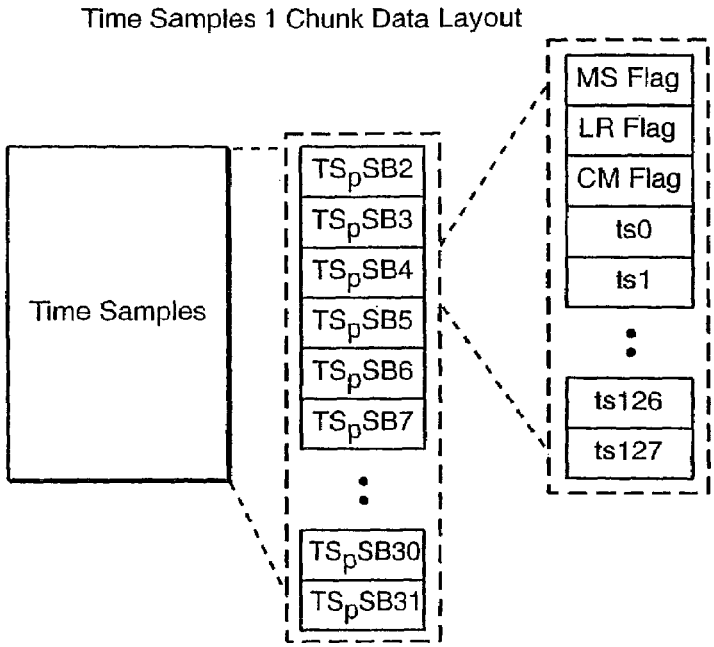
FIGS. 20 and 21 schematically represent time sample chunk data layouts.

The chunk data section of Time Samples 1 Chunk 909 is detailed in FIG. 20. Times Samples 1 Chunk 909 contains the remaining time sample data for primary channel sub-bands. A Code Method Flag (CM Flag) precedes the Time Samples for each sub-band indicating if packed values (set) or Huffman coding (unset) is used for the sub-band.

Figure 21:
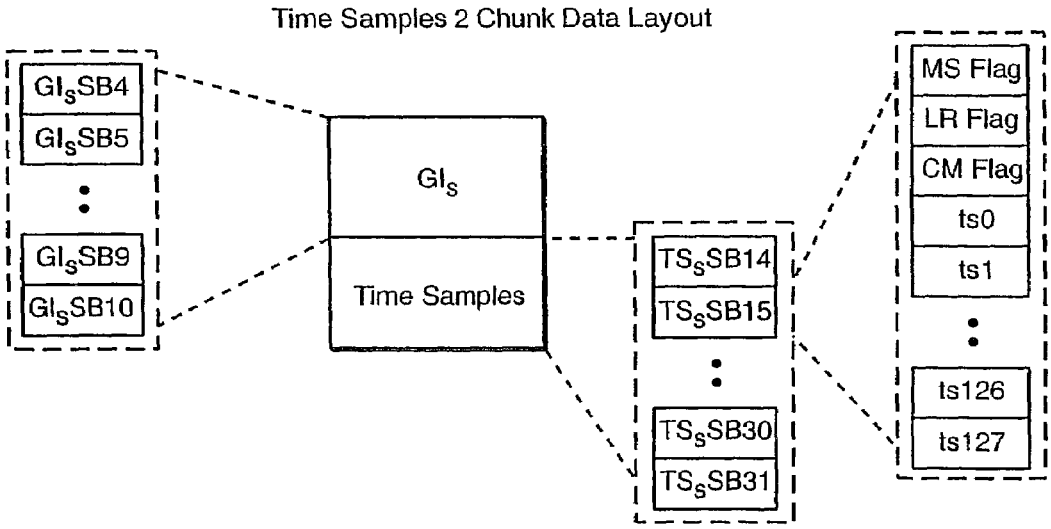

FIG. 21 provides details on the information stored in the data section of Times Samples 2 Chunk 910. Times Samples 2 Chunk 910 starts with the remaining data for G1 for secondary channels followed by the time samples for the highest frequency sub-bands of secondary channels. Preceding the time samples for each sub-band is a Code Method Flag indicating whether the samples for the band are packed values (set) or Huffman coded (unset).

The Null Chunk 911 is used to pad chunks, in this case Frame Chunk 900, when chunks are required to be a constant or specific size. One example of when a Null Chunk would be used is when data was required to be read from even byte boundaries, as is required on some microprocessors.

Decoder

Figure 13:
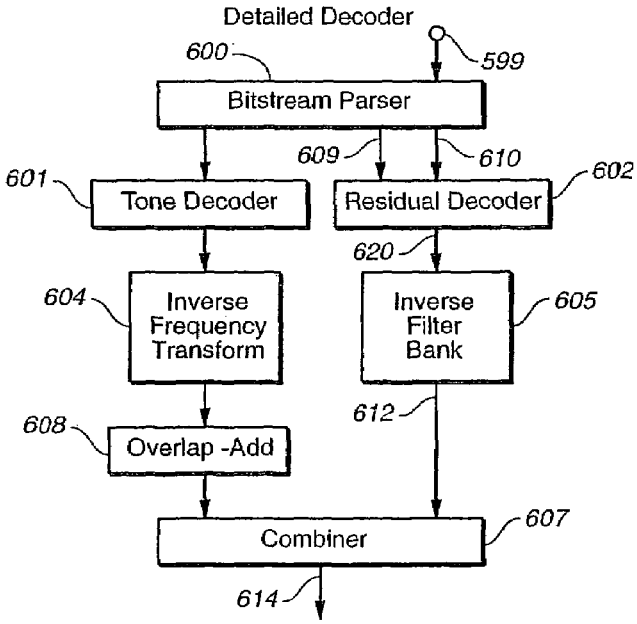
FIG. 13 shows the detailed block diagram of one implementation of the decoder used in the present invention.

FIG. 13 shows the block diagram for the decoder. The Bitstream Parser 600 reads initial side-chain information consisting of: the sample rate in hertz of the encoded signal before encoding, the number of channels of audio, the original bit rate of the stream, and the encoded bit rate. This initial side band information allows it to reconstruct the full data rate of the original signal. Further elements in bit stream 599 are parsed by the Bitstream Parser 600 and passed to the appropriate decoding element: Tone Decoder 601 or Residual Decoder 602. Elements decoded via the Tone Decoder 601 are processed through the Inverse Frequency Transform 604 which converts the signal back into the time domain. The Overlap-Add block 608 adds the values of the last half of the previously decoded frame to the values of the first half of the just decoded frame which is the output of Inverse Frequency Transform 604. Elements which the Bitstream Parser 600 determines to be part of the residual decoding process are processed though the Residual Decoder 602. The output of the Residual Decoder 605, containing 32 frequency sub-bands represented in the time domain, is processed through the Inverse Filter Bank 605. Inverse Filter Bank 605 recombines the 32 sub-bands into one signal to be combined with the output of the Overlap-Add 608 in Combiner 607. The output of Combiner 607 is the decoded output signal 614. Further details regarding these blocks will now be described.

Bitstream Parser 600

The Bitstream Parser 600 reads IFF chunk information from the bit stream and passes elements of that information on to the appropriate decoder, Tone Decoder 601 or Residual Decoder 602. It is possible that the bit stream may have been scaled before reaching the decoder by the Apparatus for Bitstream Scaling, to be subsequently described. Depending on the method of scaling employed, psychoacoustic data elements at the end of a chunk may be invalid due to missing bits. Tone Decoder 601 and Residual Decoder 602 appropriately ignore data found to be invalid at the end of a chunk. An alternative to Tone Decoder 601 and Residual Decoder 602 ignoring whole psychoacoustic data elements, when bits of the element are missing, is to have these decoders recover as much of the element as possible by reading in the bits that do exist and filling in the remaining missing bits with zeros, random patterns or patterns based on preceding psycho acoustic data elements. Although more computationally intensive, the use of data based on preceding psychoacoustic data elements is preferred because the resulting decoded audio can more closely match the original audio signal.

Tone Decoder 601

Tone information found by the Bitstream Parser 600 is processed via Tone Decoder 601. Re-synthesis of tonal components is performed using an Inverse Fast Fourier Transform whose size is the same size as the smallest transform size used to extract the tonal components.

The following steps are performed for tonal decoding:

a) Initialize the frequency domain sub-frame with zero values
b) Re-synthesize the required portion of tonal components from the smallest transform size into the frequency domain sub-frame
c) Re-synthesize and add at the required positions, tonal components from the other four transform sizes into the same sub-frame. The re-synthesis of these other four transform sizes can occur in any order.

Tone Decoder 601 decodes the following values for each transform size grouping: quantized amplitude, quantized phase, spectral distance from the previous tonal component for the grouping, and the position of the component within the full frame. For multi-channel signals, the secondary information is stored as differences from the primary channel values and needs to be restored to absolute values by adding the values obtained from the bit stream to the value obtained for the primary channel. Further processing on secondary channels are done independently of the primary channel. If Tone Decoder 601 is not able to fully acquire the elements necessary to reconstruct a tone from the chunk, that tonal element is discarded. The quantized amplitude is dequantized using the inverse of the table used to quantize the value in the encoder. The quantized phase is dequantized using the inverse of the linear quantization used to quantize the phase in the encoder. The absolute frequency spectral position is determined by adding the difference value obtained from the bit stream to the previously decoded value. Defining Amplitude to be the dequantized amplitude, Phase to be the dequantized phase, and Freq to be the absolute frequency position, the following pseudo-code describes the re-synthesis of tonal components of the smallest transform size:

```
Re[Freq]+=Amplitude*sin(2*Pi*Phase/8);

Im[Freq]+=Amplitude*cos(2*Pi*Phase/8);

Re[Freq+1]+=Amplitude*sin(2*Pi*Phase/8);

Im[Freq+1]+=Amplitude*cos(2*Pi*Phase/8);
```

Re-synthesis of longer base functions are spread over more sub-frames therefore the amplitude and phase values need to be updated according to the frequency and length of the base function. The following pseudo-code describes how this is done:

```
xFreq = Freq >> (Group − 1);
CurrentPhase = Phase − 2 * (2 * xFreq + 1);
for (i = 0; i < length; i = i + 1)
{
  CurrentPhase += 2 * (2 * Freq + 1)/length;
  CurrentAmplitude = Amplitude * Envelope[Group][i];
```

-continued

```
Re[i][xFreq] += CurrentAmplitude * sin( 2 * Pi * CurrentPhase/8 );
Im[i][xFreq] += CurrentAmplitude * cos( 2 * Pi * CurrentPhase/8 );
Re[i][xFreq + 1] += CurrentAmplitude * sin( 2 * Pi * CurrentPhase/8 );
Im[i][xFreq + 1] += CurrentAmplitude * cos( 2 * Pi * CurrentPhase/8 );
}
```

where:

Amplitude, Freq and Phase are the same as previously defined.

Group is a number representing the base function transform size, 1 for the smallest transform and 5 for the largest.

length is the sub-frames for the Group and is given by:

length=−2^(Group−1)

>> is the shift right operator.

CurrentAmplitude and CurrentPhase are stored for the next sub-frame.

Envelope[Group] [i] is triangular shaped envelope of appropriate length (length) for each group, being zero valued at either end and having a value of 1 in the middle.

Re-synthesis of lower frequencies in the largest three transform sizes via the method described above, causes audible distortion in the output audio, therefore the following empirically based correction is applied to spectral lines less than 60 in groups 3, 4, and 5:

```
    xFreq = Freq >> (Group − 1);
    CurrentPhase = Phase − 2 * (2 * xFreq + 1);
    f_dlt = Freq − (xFreq << (Group − 1));
    for (i = 0; i < length; i = i + 1)
    {
    CurrentPhase += 2 * (2 * Freq + 1)/length;
    CurrentAmplitude = Amplitude * Envelope[Group][i];
    Re_Amp = CurrentAmplitude * sin(2 * Pi * CurrentPhase/8);
    Im_Amp = CurrentAmplitude * cos(2 * Pi * CurrentPhase/8);
    a0 = Re_Amp * CorrCf[f_dlt][0];
    b0 = Im_Amp * CorrCf[f_dlt][0];
    a1 = Re_Amp * CorrCf[f_dlt][1];
    b1 = Im_Amp * CorrCf[f_dlt][1];
    a2 = Re_Amp * CorrCf[f_dlt][2];
    b2 = Im_Amp * CorrCf[f_dlt][2];
    a3 = Re_Amp * CorrCf[f_dlt][3];
    b3 = Im_Amp * CorrCf[f_dlt][3];
    a4 = Re_Amp * CorrCf[f_dlt][4];
    b4 = Im_Amp * CorrCf[f_dlt][4];
    Re[i][abs(xFreq − 2)] −= a4;
    Im[i][abs(xFreq − 2)] −= b4;
    Re[i][abs(xFreq − 1)] += (a3 − a0);
    Im[i][abs(xFreq − 1)] += (b3 − b0);
    Re[i][xFreq] += Re_Amp - a2 − a3;
    Im[i][xFreq] += Im_Amp - b2 − b3;
    Re[i][xFreq + 1] += a1 + a4 - Re_Amp;
    Im[i][xFreq + 1] += b1 + b4 - Im_Amp;
    Re[i][xFreq + 2] += a0 − a1;
    Re[i][xFreq + 3] += a2;
    Im[i][xFreq + 3] += a2;
}
```

where:

Amplitude, Freq, Phase, Envelope[Group] [i], Group, and Length are all as previously defined.

CorrCf is given by Table 2 (FIG. 25).

abs(val) is a function which returns the absolute value of val

Since the bit stream does not contain any information as to the number of tone components encoded, the decoder just reads tone data for each transform size until it run out of data for that size. Thus, tone elements removed from the bit stream by external means, has no affect on the decoder's ability to handle data still contained in the bit stream. Removing elements from the bit stream just degrades audio quality by the amount of the data element removed. Tonal chunks can also be removed, in which case the decoder does not perform any reconstruction work of tonal components for that transform size.

Inverse Frequency Transform 604

The Inverse Frequency Transform 604 is the inverse of the transform used to create the frequency domain representation in the encoder. The current embodiment employs an Inverse Fast Fourier Transform which is the inverse of the smallest FFT used to extract tones by the encoder.

Residual Decoder 602

Figure 14:
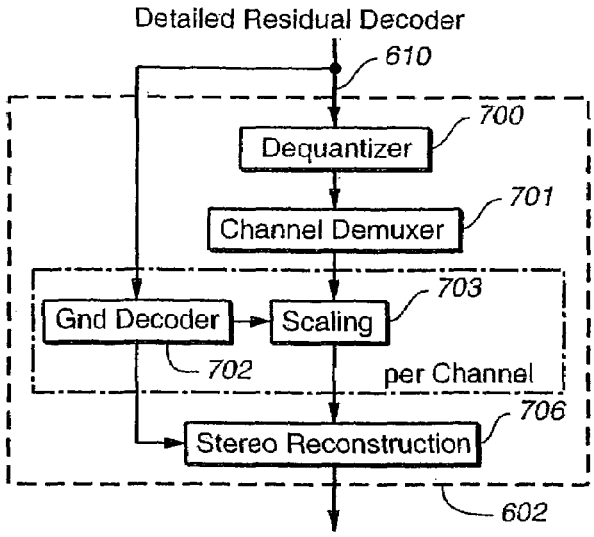
FIG. 14 is a detailed block diagram of the residual decoder used in an embodiment of the decoder of the present invention.

A detailed block diagram of Residual Decoder 602 of FIG. 13 is shown in FIG. 14. Bitstream Parser 600 passes G1 elements from the bit stream to Grid Decoder 702 on line 610. Grid Decoder 702 decodes G1 to recreate G0 which is 32 frequency sub-bands by 64 time intervals. The bit stream contains-quantized G1 values and the distances between those values. G1 values from the bit stream are dequantized using the same dequantization table as used to dequantize tonal component amplitudes. Linear interpolation between the values from the bit stream leads to 8 final G1 amplitudes for each G1 sub-band. Sub-bands 0 and 1 of G1 are initialized to zero, the zero values being replaced when sub-band information for these two sub-bands are found in the bit stream. These amplitudes are then weighted into the recreated G0 grid using the weights from Table 1.

Dequantizer 700

Time samples found by Bitstream Parser 600 are dequantized in Dequantizer 700. Dequantizer 700 dequantizes time samples from the bit stream using the inverse process of the encoder. Time samples from sub-band zero are dequantized to 16 levels, sub-bands 1 and 2 to 8 levels, sub-bands 11 through 25 to three levels, and sub-bands 26 through 31 to 2 levels. Any missing or invalid time samples are replaced with a pseudo-random sequence of values in the range of −1 to 1 having a white-noise spectral energy distribution. This improves scaled bit stream audio quality since such a sequence of values has characteristics that more closely resemble the original signal than replacement with zero values.

Channel Demuxer 701

Secondary channel information in the bit stream is stored as the difference from the primary channel for some sub-bands, depending on flags set in the bit stream. For these sub-bands, Channel Demuxer 701, restores values in the secondary channel from the values in the primary channel and difference values in the bit stream. If secondary channel information is missing the bit stream, secondary channel information can roughly be recovered from the primary channel by duplicating the primary channel information into secondary channels and using the stereo grid, to be subsequently discussed.

Stereo Reconstruction 706

Stereo Reconstruction 706 is applied to secondary channels when no secondary channel information (time samples) are found in the bit stream. The stereo grid, reconstructed by Grid Decoder 702, is applied to secondary times samples, recovered by duplicating the primary channel time sample information, to maintain the original stereo power ratio between channels.

Apparatus for Bit Stream Scaling

Figure 23:
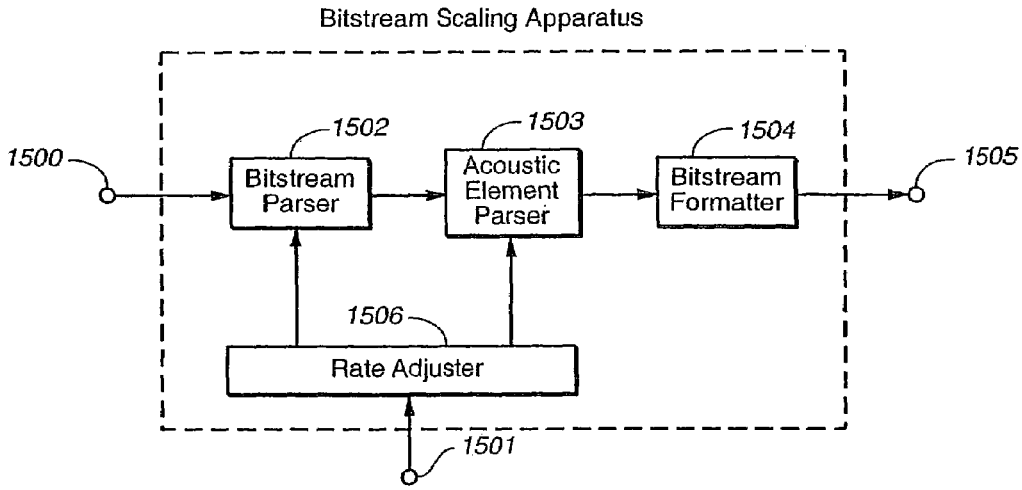
FIG. 23 depicts the block diagram of an embodiment of the bit scaling apparatus used by the present invention.

An apparatus for scaling a bit stream encoded as per above is now described with reference to FIG. 23. For the embodiment described, a new lower data rate bit stream is created from bit stream input 1500. Direct data rate scaling of the input bit stream is also possible. The current apparatus takes as one input, 1500, a bit stream coded by the Scalable Bit Stream Encoder depicted in FIG. 6, and a second input, 1501, the desired new bit rate. Bit Stream Parser 1502 reads initial side-chain information and bit stream chunk data in a manner similar to that of Bit Stream Parser 600 of the Scalable Bit Stream Decoder shown in FIG. 8. Note that if the desired new bit rate on second input 1501 is greater than or equal to the input bit rate, input bit stream 1500 is replicated and passed through the apparatus to output 1505.

To produce an output bit rate less than that displayed by input bit stream 1500, the unique bit stream scaling apparatus under discussion first calculates the number of bits per frame allowed by the new bit rate. This is done by dividing the desired new bit rate by the fixed frame rate of the bit stream. The embodiment of the present invention employs a frame rate of 10.75 frames per second (1 divided by 93 milliseconds per frame), though other frame rates could be chosen for other embodiments. As the current apparatus employs a chunk format where the value in Frame Chunk Length 915, as shown in FIG. 7, specifies the number of bytes of data within the Scalable Frame Chunk, the equivalent number of allowable bytes per frame for the new desired bit rate is calculated by dividing the bits per frame allowed by the new bit rate by eight, eight being the number of bits to a byte. Another implementation can be made, using another bit stream format, which allows for data manipulation down to the bit level. A new bit stream is created in Bitstream Parser 1502 that will be the output of the bit stream scaling apparatus. The apparatus sequentially reads the chunk IDs and chunk lengths from chunks in input bit stream 1500 and a running total of the number of bytes read is kept. For each chunk ID and chunk length read, a check is performed to see if reading the data in the chunk will exceed the new number of bytes per frame allowed by the new data rate. If the new total number of bytes already processed and bytes for the current chunk is smaller than the number of bytes allowed for the frame by the new bit rate, the entire chunk is read and placed into the new bit stream created at the beginning of the process. A running total of the number of bytes so read and placed in the new bit stream is kept so that the chunk length for the whole frame in the new bit stream can be appropriately updated at the end of processing. Also, if the frame has the two checksum bytes, a running checksum of the bytes read is also kept to update the checksum for the frame at the end of processing, otherwise the checksum calculation is not made. If the amount of data in the chunk being read will exceed the number of bytes allowed by the new bit rate, data from the chunk in the bit stream is read, but not decoded, one acoustic quanta at a time, the quanta being appropriate to data stored in the chunk. For example, an acoustic quanta in a Time Samples chunk is an individual time sample. For each quanta read, a check is made to see if placing the data amount of the quanta in the new bit stream will exceed the number of bytes allowed for the frame. If the size of the acoustic quanta is less than one byte, and the byte limit for the frame has not been reached, the quanta is packed into a temporary storage byte, starting from the last bit position used in the temporary storage byte, until the byte is filled. Once the byte is filled, the byte is written to the new stream, the appropriate running totals are updated and processing of quanta continues; the temporary storage byte being re-initialized to all bits being unset. If the size of the quanta is greater than a byte, and does not exceed the number of bytes allowed in the frame, the quanta is read and placed in the new bit stream, and the appropriate running totals are updated. A running total of the number of bytes read for the chunk is kept so that the chunk length of the chunk can be updated in the new bit stream at the end of processing. If the amount of data for the quanta will make the new bit stream exceed the new bit rate, further processing on the input stream is halted. The chunk length for the last chunk placed in the new bit stream is updated with the new total number of bytes placed in the chunk. If the frame contains a checksum, the new checksum for the frame in the new bit stream is updated with the running checksum total that was kept. Finally, the frame chunk length for the frame chunk in the new bit stream is updated with the correct total number of bytes that are in the frame. The new bit stream is output 1505 of the bit stream scaling apparatus and has a data rate equal to or less than the bit rate specified by the second input to the apparatus, 1501. Note that another implementation can be made that manages a running average data rate for frames over a predetermined time period, for example one second, such that individual frames worth of data may exceed the overall desired data rate momentarily, but the limit on the overall data rate is still maintained. Yet another implementation might only have the ability to parse the chunks, without knowledge of the contents within the chunk. Such an implementation would shorten the bit stream by outputting a shortened chunk with the chunk length for the chunk set to amount of the data in the shortened chunk, and updating the checksum and frame chunk length appropriately. By this means, any bit, or byte, rate can be achieved.

Since changes to the desired new bit rate 1501 are allowed during the processing of a bit stream to a new bit rate, changes in values to 1501 (desired new bit rate) are stored and applied to the processing of the next frame of data in the stream.

Although the various aspects of the present invention have been described with respect to specific embodiments thereof, it will be understood that the invention is entitled to protection within the full scope of the appended claims.

We claim:

1. A method of encoding a data stream to produce a compressed bitstream having a bit rate lower than or equal to the maximum bit rate of a channel, comprising:

separating the data stream into a plurality of frequency components by performing at least one frequency transformation on at least one block of time domain data samples from said data stream;

extracting a plurality of tones from said frequency components, said tones comprising signal frequency components approximating a defined base function;

ranking extracted tones in order of psychoacoustic importance;

selecting a subset of extracted tones for tone encoding, based on said ranking in order of psychoacoustic importance;

reconstructing a time domain data stream representing said data stream with said subset of extracted tones removed;

bandpass subband filtering said reconstructed time domain signal to separate said reconstructed time domain signal into a plurality of time domain subband signals;

ranking said time domain subband signals in order of psychoacoustic importance, from most important to least important;

encoding the selected subset of extracted tones to produce encoded tone data;

encoding a subset of said time domain subband signals to produce encoded subband signal data; and formatting said encoded tone data and encoded subband signal data into a compressed frame of data in the compressed bitstream, wherein said frame having multiplexed header, tone data, and subband signal data corresponding to a common time frame.

2. The method of claim 1, wherein said step of extracting tones comprises representing said tones by a set of tone parameters including at least frequency, amplitude, phase, duration, and position within a time frame.

3. The method of claim 2 wherein relatively more important subband signals are quantized at a higher number of quantization levels than relatively lower subband signals.

4. The method of claim 2 wherein said step of separating the data stream includes for at least one block of time domain samples in a channel, performing multiple frequency transformations in parallel upon said block and upon multiple sub-blocks of time domain samples, with a first transformation upon said block and further frequency transformations of lesser size upon smaller sub-blocks, said sub-blocks comprising temporally sequential sets of samples that are consecutive, time domain subdivisions of said block;

detecting tones within said block and within said sub-block, by comparison with said defined periodic base function; and grouping tone parameters according to the size of the frequency transform in which the corresponding tone was detected.

5. The method of claim 4 wherein said step of extracting tones comprises reiteratively extracting tones within said blocks and within said sub-blocks.

6. The method of claim 4, comprising wherein said set of tone parameters further comprises a transform size parameter representing the size of the frequency transform in which the corresponding tone was detected.

7. The method of claim 1, wherein said step of ranking said extracted tones comprises ranking said psychoacoustic importance based on relative power of a tone over a masking level, said masking level based on a masking function.

8. The method of claim 1, further comprising the step of scaling said encoded subband signal data by discarding less important subband signal data while passing more important subband signal data.

9. The method of claim 1 wherein said step of formatting said encoded tone data and said encoded subband signal data comprises:

arranging said encoded tone data with relatively more important psychoacoustic data arranged in a bit stream earlier than relatively lower ranking encoded; and arranging said encoded subband signal data with relatively more important psychoacoustic data arranged in said bit stream earlier than relatively lower ranking encoded subband signal data.

10. The method of claim 1, further comprising the step:

Calculating scale factor grids for scaling said time-domain subband signals, said grids comprising an ordered set of scale factors corresponding to combinations of the parameters a) subband frequency, and b) subframe time.

11. The method of claim 10 wherein said step of encoding comprises:

encoding said tone parameters of the selected subset of extracted tones, encoding said time domain sub-band signals, and encoding said scale factor grids; and multiplexing corresponding encoded tone parameters, encoded time domain sub-band signals, and scale factor grids into formatted data frames representing signal time intervals.

12. The method of claim 11, wherein said encoding step further comprises:

formatting said tone parameters into tone chunks, said encoded time-domain subband signals into residual chunks, and said scale factor grids into scale factor grid chunks; and interleaving said tone chunks, said residual chunks, and said scale factor grid chunks in said formatted data frames in order of their psychoacoustic importance.

13. The method of claim 1, wherein said stem of encoding said time domain subband signals comprises:

From said plurality of time domain subband signals, Calculating a first sample matrix (G) wherein each entry corresponds to a sampled time domain subband signal in a time interval, comprising a set of samples G(i,k), where i indexes the subband in said plurality of subbands, and k indexes the time corresponding to said sample;

From said first sample matrix (G), calculating a second matrix (G0) each element of which represents a quantized maximum within groups of samples having adjacent time indices (k) in matrix G;

From said matrix G0, calculating a third matrix (G1), each element of G1 representing a quantized weighted sum of power estimates, each of said power estimates summed over a subset of neighboring entries within said matrix G0;

Recalculating a reconstructed matrix G0 from said third matrix G1;

Scaling said sample matrix by dividing each entry in G by a respective value in said reconstructed matrix G0, to obtain a scaled matrix G;

Quantizing said scaled matrix G to obtain a quantized, scaled matrix G; and

Encoding said quantized, scaled matrix G to obtain said encoded subband signal data.

14. The method of claim 13, wherein said weighted sum of power estimates is summed over 8 consecutive entries differing only in their time index (k).

15. The method of claim 13, wherein said step of quantizing said scaled matrix G comprises quantizing said matrix according to a number of quantization levels which varies as a function of the subband index (i).

16. The method of claim 13, wherein said audio signal comprises a two-channel, stereo audio signal, represented either in a left/right or a middle/side configuration, and further comprising the steps:

In each subband, designating a channel with highest power as a primary channel;

Coding the remaining channel as a secondary channel in relation to said primary channel by use of a stereo grid, said stereo grid representing the quantized ratios of the power of the secondary channel to the primary channel such that each element of the stereo grid represents the ratio between corresponding elements of said Grid G.

17. An apparatus for encoding a data stream to produce a data stream having a bit rate lower than or equal to the maximum bit rate of a recording or transmission channel, comprising:

a frequency separating module arranged to separate the data stream into a plurality of frequency components by performing a frequency transformation on a block of time domain data samples from said data stream, producing a frequency domain representation of the signal;

a tone extractor arranged to extract a plurality of tones from said frequency domain representation, said tonal components comprising signal frequency components approximating a defined base function;

a tone selector arranged to receive said extracted plurality of tonal components and to select a subset of said extracted tonal components based on psychoacoustic importance;

a residual encoder arranged to encode a residual time domain bitstream, said residual time domain bitstream representing said data stream with said selected subset of tonal components removed;

a tone encoder arranged to encode said selected subset of said extracted tonal components to produce an encoded tone data stream, said encoded tone data comprising encoded frequency, encoded amplitude, encoded phase, encoded duration, and encoded position within a time frame; and a formatter arranged to format said residual time domain bitstream and said encoded tone data stream to produce a formatted output bitstream by multiplexing together corresponding encoded tone parameters, encoded time domain sub-band signals, and scale factor grids into formatted data frames representing signal time intervals.

18. The apparatus of claim 17, further comprising:

A local decoder arranged to decode said selected subset of extracted tonal components selected by said selector, and to produce a reconstructed time domain tone signal representing said selected subset of extracted tonal components;

A signal combiner arranged to receive said reconstructed time domain tone signal and said data stream and combine said data stream with an inversion of said reconstructed time domain tone signal to form said encoded residual time domain bitstream for said residual encoder.

19. The apparatus of claim 17, wherein said residual encoder comprises:

A sub-band processor arranged to filter said residual time domain bitstream into critically sampled subband signals and to calculate scale factors in each of a plurality of subbands, said scale factors calculated independently in a plurality of overlapping sample blocks in each of said plurality of subbands.

20. The apparatus of claim 17, wherein said formatter formats said encoded tone data stream and encoded residual time domain bitstream in said formatted output bitstream with data of said residual bitstream arranged in chunks, said chunks arranged in order of psychoacoustic importance from most important to least important chunk.

21. The apparatus of claim 20 wherein said formatter further arranges data within said chunks with more psychoacoustically important data relatively earlier in each chunk than less psychoacoustically important data.

22. The apparatus of claim 7 wherein said tone extractor operates on each sample block with multiple orders of overlapping transform blocks to detect tonal components, said multiple orders of overlapping transform blocks comprising a plurality of hierarchical subblocks derived by reiteratively dividing sample blocks in the time domain; said sub-blocks comprising temporally sequential sets of samples that are consecutive, time domain subdivisions of said block.

23. The apparatus of claim 17 wherein said residual encoder filters said residual time domain signal to produce time domain frequency subband signals;

And wherein said residual encoder further arranges said subband signals into a perceptually relevant order.

24. The apparatus of claim 17, wherein said formatter is arranged to place said encoded tone data in the output bitstream in chunks arranged in time in order of perceptual importance.

25. A bitstream decoder, suitable for decoding compressed digital audio data to produce decoded digital audio data, comprising:

a bitstream parser arranged to receive the scalable bitstream and separate bitstream chunks into a) encoded tone elements and b) encoded residual sub-band elements, to pass said encoded tone elements to a tone output, and to pass said encoded residual sub-band elements to a residual outputs;

a tone decoder coupled to said tone output, arranged to receive said encoded tone elements and to decode said encoded tone elements to produce decoded tone elements;

an inverse frequency transformer arranged to convert said decoded tone elements into a time domain tone signal;

a residual decoder arranged to receive said encoded residual sub-band elements and to decode said encoded residual time domain elements, thereby producing decoded sub-band signals;

an inverse sub-band filter bank arranged to receive said decoded sub-band signals and to reconstruct said decoded sub-band signals into a time domain residual signal;

a combiner arranged to receive said time domain tone signals and said time domain residual signal and said time domain tone signal and to combine them by summation to form a decoded time domain signal.

26. The decoder of claim 25, wherein said tone decoder decodes encoded parameters conveying at least coded spectral position, coded quantized amplitude, phase, duration and coded sub-frame position for each encoded tone.

27. A method of decoding an encoded bitstream to produce a decoded signal, said encoded bitstream formatted into data frames, each frame including a header, encoded tones, and residual sub-band elements, the method comprising the steps:

parsing the encoded bitstream to separate encoded tones from encoded residual sub-band elements;

decoding said separated tones to obtain a frequency domain representation of tone signals;

performing an inverse frequency transformation on said frequency domain representation to produce a time domain tone signal;

decoding said encoded residual sub-band elements to produce decoded residual sub-band signals;

reconstructing a residual signal by inverse filtering said decoded residual sub-band signals and combining subbands; and combining said residual signal and said time domain tone signal by signal summation, to produce the decoded signal.

28. The method of claim 27, wherein said decoding of tonal components comprises:

decoding coded spectral position, quantized amplitude, phase, and temporal position for each encoded tone.

29. The method of claim 27, wherein:

said bitstream represents encoded multi-channel audio signals, and wherein said decoding of tone elements for at least one secondary channel further comprises decoding coded differences between the amplitude from a primary channel.

30. A method of encoding a bitstream comprising:

frequency transforming the bitstream to obtain a frequency domain representation;

extracting tones from said frequency domain representation;

forming a time domain residual signal representing the bitstream with at least some extracted tones removed; and encoding said extracted tones and residual signal.

31. The method of claim 30 further comprising multiplexing the encoded tones and residual signals together in a predetermined data format.

32. The method of claim 30, wherein said predetermined data format has less psychoacoustically important data positioned later in time.

33. A method for compressing a digital audio bitstream to produce an output bitstream at a desired bit rate less than that of the original bitstream, comprising:

Encoding the digital audio bitstream as a series of chunks of quantized audio data, By:

frequency transforming the bitstream to obtain a frequency domain representation;

extracting tones from said frequency domain representation, forming a time domain residual signal representing the bitstream with at least some extracted tones removed, encoding the extracted tones and the residual signal to form encoded data, and formatting said extracted tones and residual signal into a plurality of data chunks, each said data chunk comprising a plurality of bytes of data;

ordering said chunks in a frame format in order of psychoacoustic importance, thereby producing an ordered bitstream; and eliminating relatively less psychoacoustically important chunks from said ordered bitstream to achieve the desired bit rate less than that of the original digital audio bitstream.

* * * * *